US006990888B2

(12) United States Patent
Harwath et al.

(10) Patent No.: US 6,990,888 B2
(45) Date of Patent: Jan. 31, 2006

(54) MECHANISM FOR SWITCHING BETWEEN CLOSED AND OPEN CENTER HYDRAULIC SYSTEMS

(75) Inventors: Julie Harwath, Oregon, IL (US); Orville Diekmann, Fairmont, MN (US)

(73) Assignee: Greenlee Textron Inc., Rockford, IL (US)

( * ) Notice: Subject to any disclaimer, the term of this patent is extended or adjusted under 35 U.S.C. 154(b) by 245 days.

(21) Appl. No.: 10/702,297

(22) Filed: Nov. 6, 2003

(65) Prior Publication Data

US 2005/0016375 A1 Jan. 27, 2005

Related U.S. Application Data

(60) Provisional application No. 60/490,160, filed on Jul. 25, 2003.

(51) Int. Cl.
*F15B 11/08* (2006.01)

(52) U.S. Cl. ..... 91/428; 91/437

(58) Field of Classification Search ..... 91/428, 91/444, 454, 437
See application file for complete search history.

(56) References Cited

U.S. PATENT DOCUMENTS

| | | | | |
|---|---|---|---|---|
| 2,389,654 | A | 11/1945 | Van Der Werff | |
| 3,694,839 | A | 10/1972 | Loblick | |
| 3,770,007 | A * | 11/1973 | Orth et al. | 137/501 |
| 3,882,883 | A | 5/1975 | Drogemueller | |
| 4,256,433 | A | 3/1981 | King | |
| 4,273,029 | A | 6/1981 | Sheppard | |
| 4,366,673 | A | 1/1983 | Lapp | |
| 4,548,229 | A | 10/1985 | Johnson | |
| 4,589,437 | A | 5/1986 | Zeuner et al. | |
| 4,860,646 | A | 8/1989 | Spiers | |
| 5,419,129 | A * | 5/1995 | Becker et al. | 60/452 |
| 5,442,992 | A | 8/1995 | Sanner et al. | |
| 5,778,755 | A | 7/1998 | Boese | |
| 6,490,962 | B1 * | 12/2002 | Schultz | 91/428 |
| 6,679,340 | B1 * | 1/2004 | Tatai | 91/428 |
| 6,902,011 | B2 * | 6/2005 | Hall | 173/169 |

* cited by examiner

*Primary Examiner*—Thomas E. Lazo
(74) *Attorney, Agent, or Firm*—Trexler, Bushnell, Giangiorgi, Blackstone & Marr, Ltd.

(57) ABSTRACT

A mechanism is provided for use with a hydraulic control mechanism of a hydraulic tool. The hydraulic control mechanism is attached to the hydraulic tool to provide a desired hydraulically powered function. The mechanism allows the hydraulic control mechanism to be used with either a constant volume hydraulic system or a constant pressure hydraulic system. The mechanism provides a valve chamber and a valve member positioned within the valve chamber. The valve chamber communicates with both a central passageway and a cross passageway of the hydraulic control mechanism. The valve chamber defines a valve seat proximate to one of the central and cross passageways. The valve member is displaceable within the valve chamber and is configured such that, depending on the position of the valve member within the valve chamber, the hydraulic control mechanism can be used with either a constant volume hydraulic system or a constant pressure hydraulic system.

30 Claims, 12 Drawing Sheets

MECHANISM FOR SWITCHING BETWEEN CLOSED AND OPEN CENTER HYDRAULIC SYSTEMS

CROSS-REFERENCE

This patent application claims the benefit of domestic priority of U.S. Provisional Application Ser. No. 60/490,160, filed Jul. 25, 2003, and entitled "Mechanism For Switching Between Closed Center And Open Center Hydraulic Systems".

BACKGROUND OF THE INVENTION

This invention is directed generally to a mechanism for operating a hydraulic tool. More particularly, the present invention is directed to a mechanism employing a novel adjustment assembly for a hydraulic tool which allows the tool to be used with either a constant pressure hydraulic fluid system or a constant volume hydraulic fluid system without requiring disassembly or replacement of any parts in the tool.

Hydraulic tools generally operate using one of two basic types of hydraulic systems. The hydraulic systems which are used to operate such tools include the constant volume system and the constant pressure system.

In the constant volume system, the hydraulic fluid, such as oil, must be free to flow back to the power source in an off or neutral position. The constant volume system uses an on-off control valve arrangement which has an open-center spool to allow the hydraulic fluid to flow through the valve and back to the source when the valve is in its off or neutral position. As such, the terms "constant volume" and "open-center" are used interchangeably with respect to this type of system. In the open-center system, a positive displacement pump is used which continuously pumps hydraulic fluid through the system.

In the constant pressure system, the hydraulic pump operates only intermittently to achieve and maintain a desired pressure. A control valve associated with a constant pressure system employs a closed center spool to prevent fluid flow therethrough in the off or neutral position in order to maintain a desired system pressure. As such, the terms "constant pressure" and "closed-center" are used interchangeably. In the closed-center system, the system operates until a predetermined pressure is sensed whereupon the pump "destrokes" and the pressure compensated pump apparatus then operates to pump just enough to maintain the desired pressure. Various pumps or systems of this type are well known in the art.

Hydraulically driven tools are used in many applications in the field, for example, by utility companies for making crimp connections on power lines or by municipalities and park districts for operating pruning devices for tree management and maintaining landscaping. It should be understood that while the present invention is shown in connection with both a crimping device and a pruning device, the present invention will find applications in a variety of hydraulically operated tools.

Many of the foregoing users of such tools frequently employ both constant pressure type and constant volume type hydraulic power sources. For example, various equipment such as central hydraulic power sources or trucks which are used in the field, may be equipped with one or the other type of hydraulic power source. Typically, it is undesirable or economically restrictive to maintain both types of power sources in each field location. Without being able to know which type of hydraulic power source will be used in any particular field application, many users of such hydraulic tools found it necessary or desirable to maintain duplicate sets of tools in order to operate with either type of system. Providing duplicate sets of tools, however, represents a substantial capital investment as well as storage and maintenance costs even though it overcomes the problems associated with having only one type of hydraulic power system. Further, maintaining duplicate sets of tools requires additional space and additional training to make sure that the proper tool is used with the proper type of hydraulic system. Alternatively, one set of tools may be maintained in one type of hydraulic system selected for any given application. Some devices, such as trucks, however, are provided with only one type of hydraulic system and therefore this may not be a feasible solution.

Another way of solving the problems associated with the two different types of hydraulic power sources is to design tools with interchangeable components, such as two spool valves, one spool valve designed for open-center operation and the other spool valve designed for closed-center operations. The operator of the tool could then select and install the proper spool to match the hydraulic power source. This, however, would require that duplicate spools be available for use with each tool, again requiring additional inventory and storage costs as well as space requirements. Moreover, providing interchangeable spool valves would require the operator to expend the time necessary to effect the change over and also have sufficient training and skills to properly disassembly and reassembly the valve portion of each tool.

Assuming that the problems associated with inventory and storage costs and space requirements and operator skill and training are overcome, the dual valve spools require additional time at the job site for disassembly and reassembly of the valves. Another problem arises in that the frequent removal and replacement of the valve spools will also unnecessarily disturb the hydraulic system and seals and produce increased tool wear and the opportunity for the introduction of dirt and debris into the hydraulic system. Because these tools are intended for field applications, the introduction of such dirt and debris and disturbance of a hydraulic system is an important concern.

The invention disclosed in U.S. Pat. No. 3,882,883 proposed a first solution to the foregoing problems. The '883 patent discloses a valve assembly having a spool which may be rotated 180° to shift from a normally open operating mode to a normally closed operating mode. However, this valve design requires that a linkage rod be removed before the spool may be rotated. Thus, there is still the possibility of the linkage rod being improperly removed and improperly reassembled as well as possibly being lost, damaged during the removal or reassembly, or the introduction of contaminants into the system.

The invention disclosed in U.S. Pat. No. 4,548,229 proposed a second solution to the foregoing problems. The '229 patent discloses a valve assembly for accommodating both open-center and closed-center modes of operation for use with an impact wrench. This valve assembly, however, is suitable only for use with rotating tools, because the valve assembly itself is designed to shunt hydraulic fluid back to the source when the tool is in the off or neutral state, and the open-center mode of operation. This tool is provided with a specifically designed valve cylinder or sleeve which surrounds the valve spool. The sleeve is configured for open-center operation when in a first orientation and for closed-center operation when it is rotated to a second orientation approximately 180° of rotation from its first orientation. This valve is designed to permit constant flow of hydraulic fluid through the tool when the valve is in its on position in both open-center and closed center modes of operation. The valve is designed to cut off the hydraulic fluid flow at the valve itself in the closed center mode of operation when the valve is in its closed or neutral position. In other words, in both open-center and closed-center modes, when the valve is in its off or neutral position, the valve does not permit flow of fluid past the valve and there is no fluid flow to the tool. However, such a valve arrangement will not work with a reciprocating type of hydraulic tool wherein it is necessary to alternately direct flow to opposite sides of a reciprocating piston. The crimping device and the pruner disclosed herein in order to illustrate the present invention are two such types of tools which utilize a reciprocating piston, rather than a rotating rotor as used in the tools such as the impact wrench of the above-mentioned '229 patent.

The invention disclosed in U.S. Pat. No. 5,442,992 proposed a third solution to the foregoing problems. The '992 patent, which was assigned to the assignee of the present invention, shows a control system designed for use with either an open-center system or a closed-center system. The system of the '992 patent has a rotatable selector which assists in configuring the control system for use with either the open-center or closed-center system.

To overcome the disadvantages of the above-mentioned prior art, a hydraulic control mechanism was invented and disclosed in U.S. Pat. No. 5,778,755, which was assigned to the assignee of the present invention. The '755 patent discloses a hydraulic control mechanism which is attached to a hydraulically operated tool to provide a desired hydraulically powered function. The present invention allows the hydraulic control mechanism to be used with either an open-center hydraulic system or a closed-center hydraulic power system. The adjustment assembly, which utilized screws, provided a structure which could be configured to force open shuttle spool valves in the control mechanism in a neutral condition for use with an open-center power supply. The adjustment assembly can also be configured to be disengaged from the shuttle spool valves in a neutral condition for use with a closed-center hydraulic power supply. Operation of the adjustment assembly is made using standard tools and without disassembly of the control mechanism.

While the hydraulic control mechanism disclosed in the '755 patent has been well-received in the marketplace, there have also been some disadvantages associated therewith. For example, the adjustment of the screws was not convenient due to the location of the screws relative to a handle of the tool. Additionally, the components required for this method of adjustment occasionally led to fracture of the shuttle dump spools and external leakage. The number of parts required and costs to manufacture or purchase these parts, also resulted in higher manufacturing costs than desired.

Thus, there is a need for a mechanism for operating a hydraulic tool which overcomes the disadvantages associated with the prior art systems. The present invention provides such a mechanism.

OBJECTS AND SUMMARY OF THE INVENTION

A primary object of the invention is to provide a mechanism for a tool which provides for easier operation of the tool in an open-center or closed-center hydraulic system than other such tools of the prior art.

An object of the invention is to provide a tool which is configured to operate in either an open-center or closed-center hydraulic system where the parts for adjusting the tool between the open-center and closed-centers are conveniently placed for a user of the tool.

Another object of the invention is to provide a tool which is configured to operate in either an open-center or closed-center hydraulic system where the parts required for adjusting the tool between the open-center and closed-centers are low in number and cost.

Another object of the invention is to provide a configuration for a tool which can operate between both an open-center hydraulic system and a closed-center hydraulic system, but which minimizes or eliminates external leakage of the hydraulic fluid.

Yet another object of the invention is to provide a novel hydraulic fluid flow mechanism for use with a hydraulic tool which allows the tool to be converted for use with a constant volume system to a constant pressure system and vice-versa, without the disassembly or removal of any parts from the tool.

Still another object of the invention is to provide a novel hydraulic fluid flow mechanism for use with a hydraulic tool which can be quickly and easily converted for operation with either a constant volume system or a constant pressure system as a power source using available common tools and skills.

Another object of the invention is to provide a novel hydraulic fluid flow mechanism based on a generally available and understood hydraulic tool thereby providing a hydraulic tool which can be used with either a constant volume system or a constant pressure system without requiring additional training or the maintenance of such a hydraulic tool.

Briefly, and in accordance with the foregoing, a mechanism is provided for use with a hydraulic control mechanism of a hydraulic tool. The hydraulic control mechanism is attached to the hydraulically operated tool to provide a desired hydraulically powered function. The mechanism of the present invention allows the hydraulic control mechanism to be used with either a constant volume hydraulic system or a constant pressure hydraulic system. The mechanism provides a valve chamber and a valve member positioned within the valve chamber. The valve chamber communicates with both a central passageway and a cross passageway of the hydraulic control mechanism. The valve chamber defines a valve seat proximate to one of the central and cross passageways. The valve member is displaceable within the valve chamber and is configured such that, depending on the position of the valve member within the valve chamber, the hydraulic mechanism can be used with either a constant volume hydraulic system or a constant pressure hydraulic system.

BRIEF DESCRIPTION OF THE DRAWINGS

The features of the invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
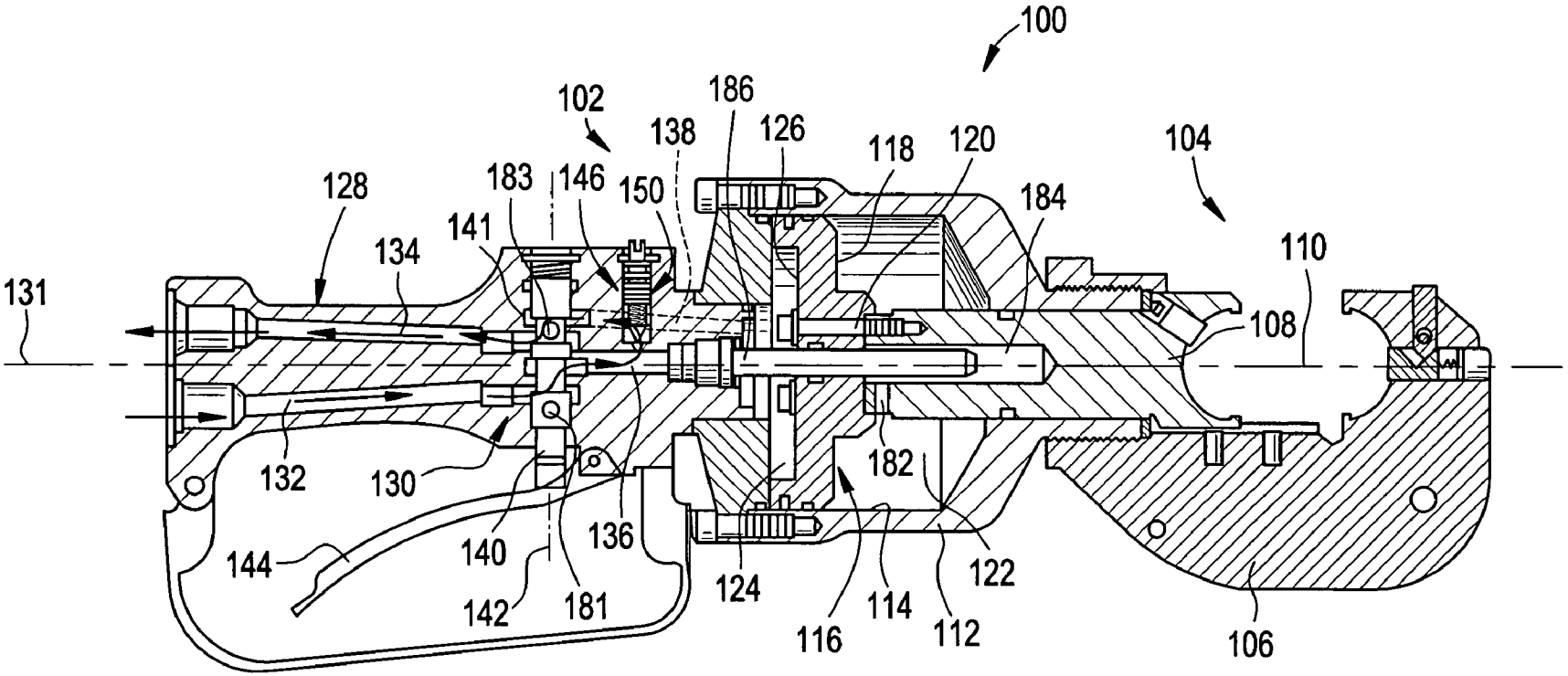
FIG. 1 is a partial fragmentary, cross-sectional view of a hydraulic crimping tool which incorporates features in accordance with a first embodiment of the invention, which is configured for use with a constant volume or "open-center" hydraulic power system in which a reciprocal piston and a crimping ram attached thereto are in a retracted position with the system in a neutral condition.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

A first embodiment of the invention in which a crimping tool 100 is shown to have a novel control mechanism 102, which incorporates features of the invention, is illustrated in FIGS. 1–8 with reference numerals being in the one hundreds. A second embodiment of the invention in which a utility pruner tool 300 is shown to have a novel control mechanism 302, which incorporates features of the invention, is illustrated in FIGS. 9–16 with reference numerals being in the three hundreds. Like reference numerals in the first and second embodiments denote like elements.

Crimping Tool 100 Having The Novel Control mechanism 102

Figure 2:
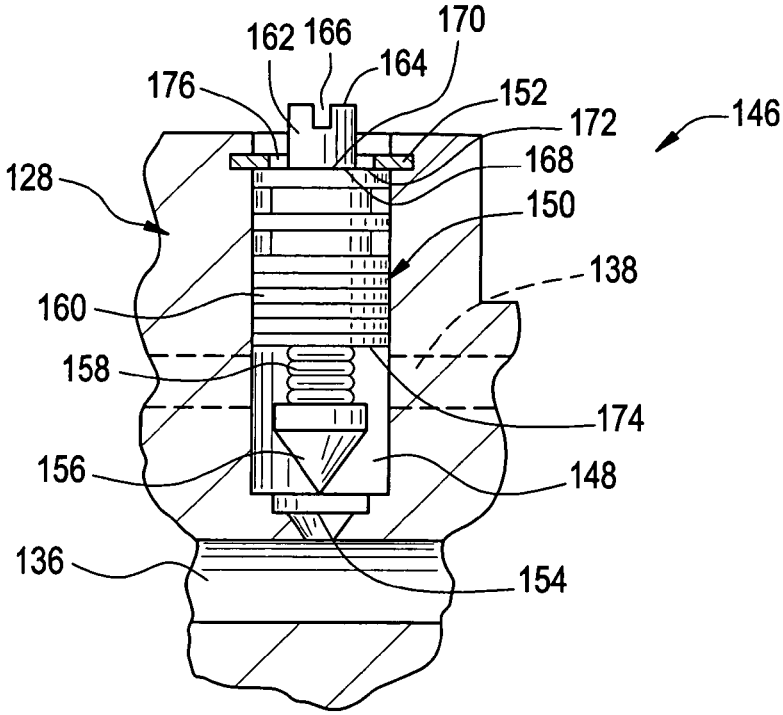
FIG. 2 is an enlarged, partial fragmentary, cross-sectional view of an adjustment assembly of the hydraulic crimping tool illustrated in FIG. 1.
Figure 5:
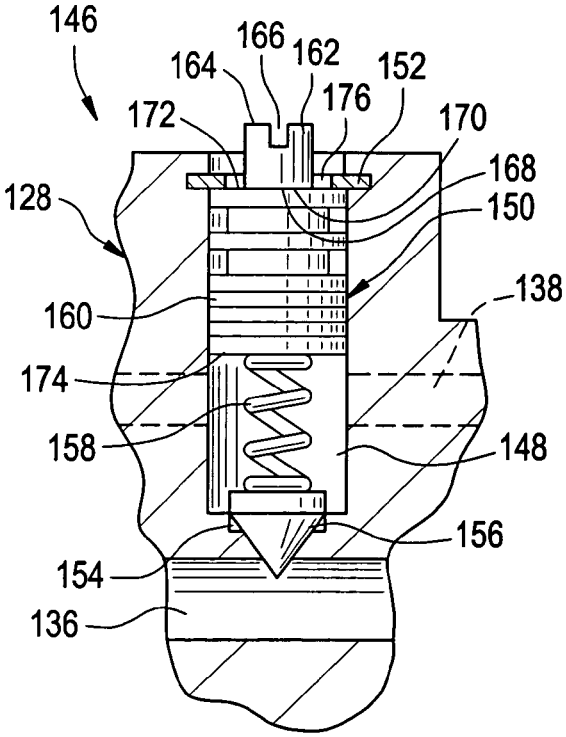
FIG. 5 is an enlarged, partial fragmentary, cross-sectional view of the adjustment assembly of the hydraulic crimping tool illustrated in FIGS. 3 and 4.
Figure 8:
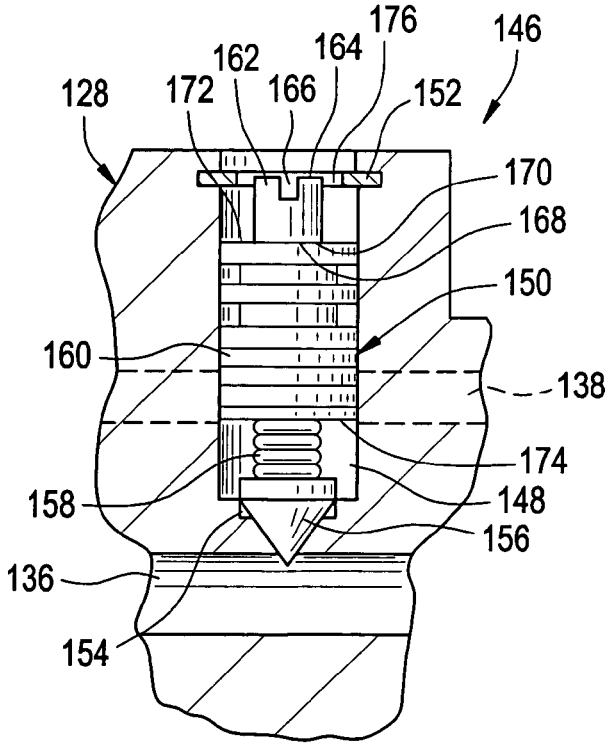
FIG. 8 is an enlarged, partial fragmentary, cross-sectional view of the adjustment assembly of the hydraulic crimping tool illustrated in FIGS. 6 and 7.
Figure 6:
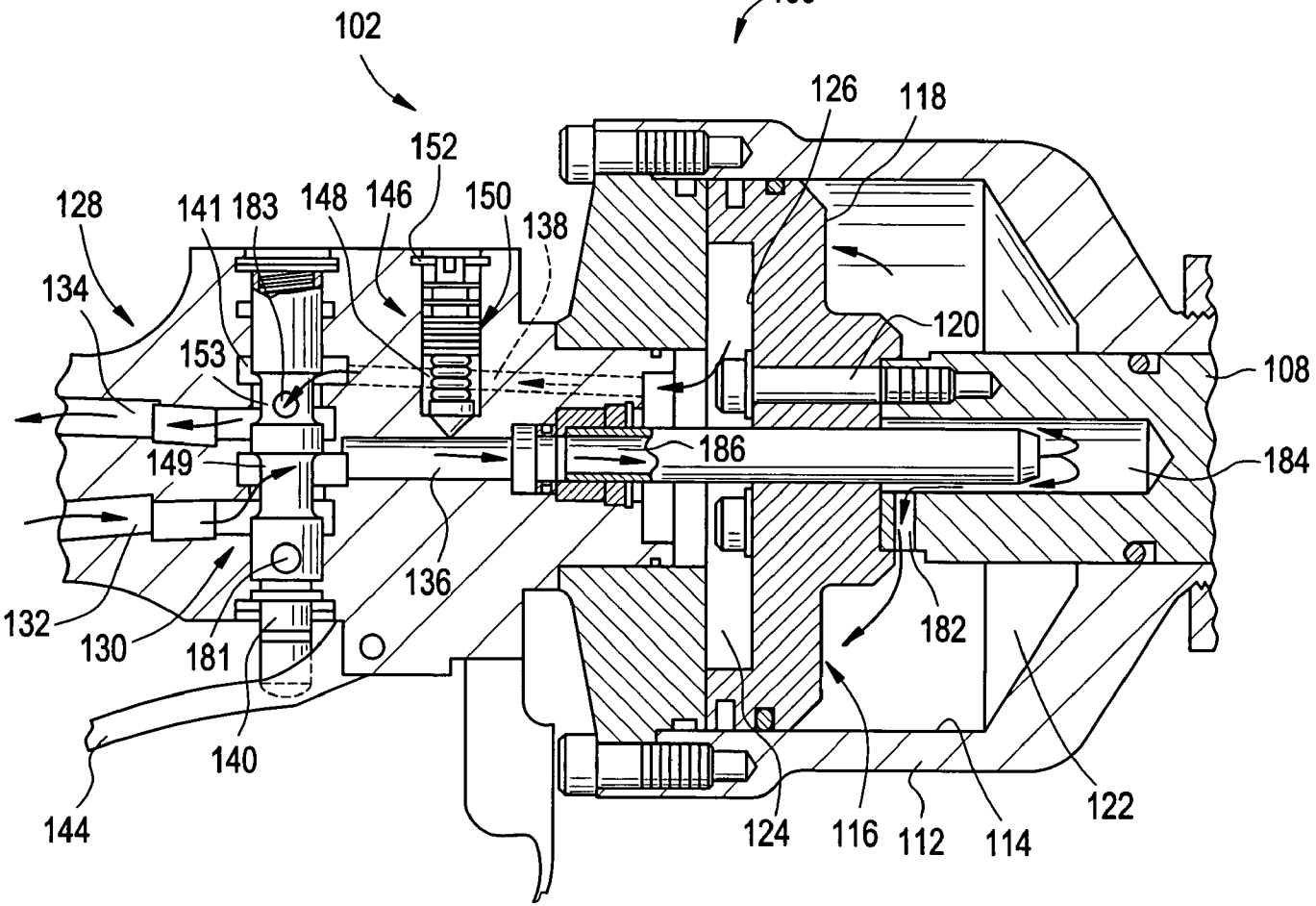
FIG. 6 is an enlarged, partial fragmentary, cross-sectional view of the crimping tool as shown in FIGS. 1–5 which has been configured for operation with a constant pressure or "closed-center" hydraulic power system in the trigger deactivated condition in which the piston and crimping ram are in a retracted position.
Figure 7:
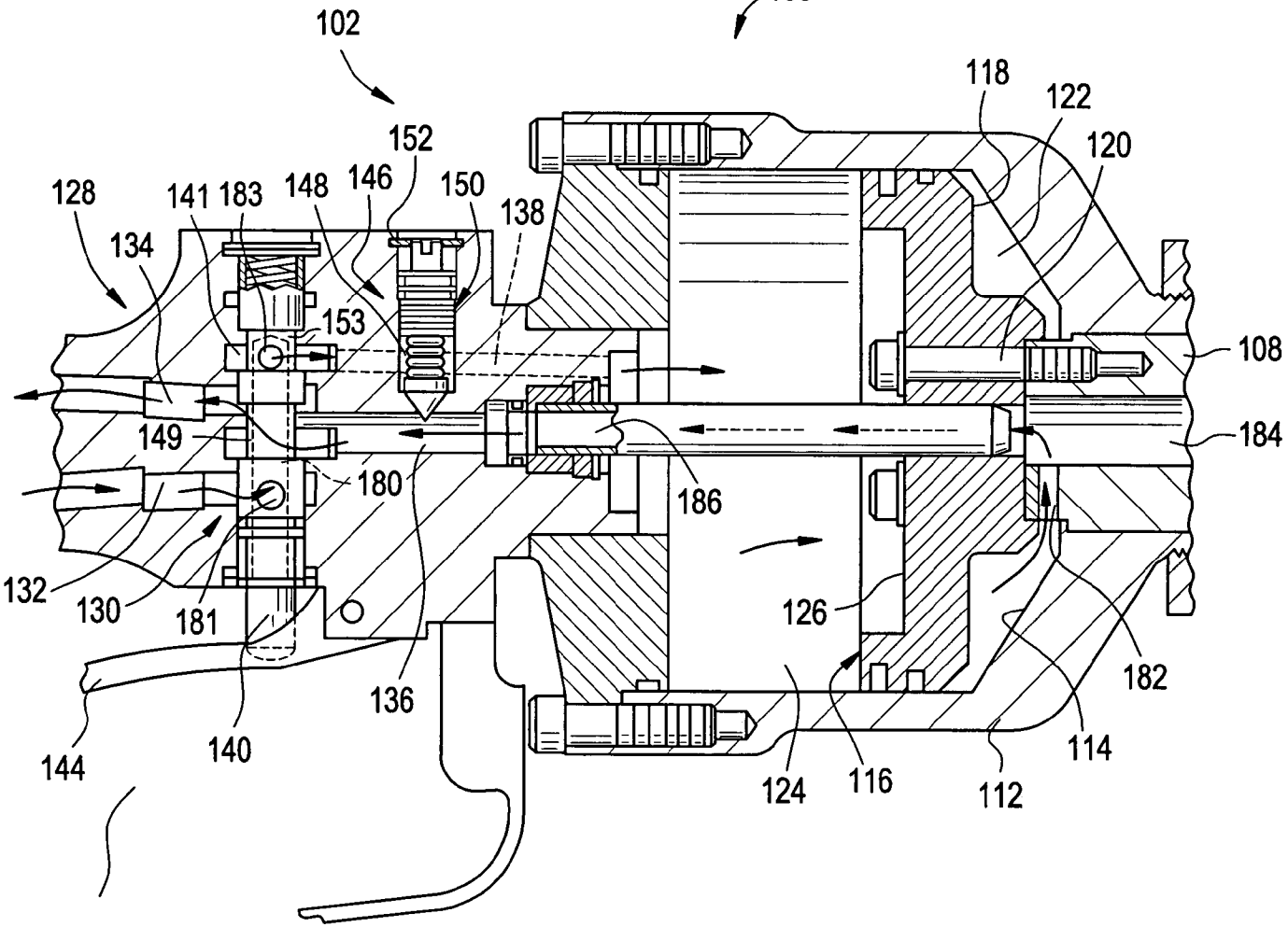
FIG. 7 is an enlarged, partial fragmentary, cross-sectional view showing the control mechanism of the crimping tool as shown in FIG. 6 in the trigger activated condition in which the crimping ram is advanced by hydraulic forces acting on the reciprocal piston of the control mechanism.

FIGS. 1–5 show the control mechanism 102 of the crimping tool 100 employed with a constant volume or open-center hydraulic power system, whereas FIGS. 6–8 show the control mechanism 102 of the crimping tool 100 employed with a constant pressure or closed-center hydraulic power system. Further, FIG. 1 has been provided to show the entire crimping tool 100, whereas FIGS. 3, 4, 6 and 7 have been substantially enlarged to show only a portion of the crimping tool 100 which includes the control mechanism 102 of the crimping tool 100. FIGS. 2, 5 and 8 illustrate enlarged views of the control mechanism 102, specifically illustrating an adjustment assembly 146 of the control mechanism 102.

The hydraulic crimping tool 100 includes a crimping ram unit 104 having a head 106 and a hydraulic crimping ram 108. The crimping ram unit 104 is attached to the control mechanism 102 to provide reciprocal movement of the ram 108 along the head 106. Movement of the ram 108 relative to the head 106 provides crimping forces on a crimp connection (not shown) placed in a C-shaped aperture 110 defined therebetween. The control mechanism 102 regulates hydraulic forces to advance and retract the ram 108 to provide a desired crimping effect on the crimp connection. It should be understood that the control mechanism 102 may also be used with a variety of other hydraulic tools which require the ability to be used with either an open-center or a closed-center hydraulic power system. The present disclosure is illustrated by way of reference to the crimping tool 100 as shown herein but is not limited to the crimping tool 100.

As shown in each of the FIGS. 1, 3, 4, 6 and 7, the control mechanism 102 includes a housing 112 defining a cavity 114 therein with a reciprocal piston or driving piston 116 retained in the cavity 114 for movement toward and away from the head 106. The ram 108 is attached to a first side 118 of the piston 116 by cap screws 120.

The piston 116 divides the cavity 114 into a retract chamber 122 and a drive chamber 124. The retract chamber 122 is defined between the first side 118 of the piston 116 and the corresponding walls which define the cavity 114 in the housing 112. The drive chamber 124 is similarly defined between a second side 126 of the piston 116 and the corresponding walls which define the cavity 114 in the housing 112.

The control mechanism 102 includes a handle structure 128 containing a valve assembly 130. The handle structure 128 is defined about a central axis 131. An inlet passageway 132 and an outlet passageway 134 extend axially through the handle structure 128 for connection to a hydraulic power system (not shown) of a known construction. The inlet passageway 132 extends along one side of the central axis 131 while the outlet passageway 134 extends along another side of the central axis 131. The inlet passageway 132 and the outlet passageway 134 can be connected to either the constant volume system or the constant pressure system. A central passageway 136 extends axially within the handle structure 128 along the central axis 131 and selectively connects either the inlet passageway 132 or the outlet passageway 134 via the valve assembly 130 with the retract chamber 122 as will be described in greater detail hereinbelow. A cross passageway 138 extends axially within the handle structure 128, on the same side of the central axis 131 as the outlet passageway 134, and selectively connects either the inlet passageway 132 or the outlet passageway 134 via the valve assembly 130 with the drive chamber 124 as will be described in greater detail hereinbelow.

The valve assembly 130 includes a spindle valve 140 which is axially displaceable within a spindle valve chamber 141 along a spindle axis 142. The spindle axis 142 is perpendicular to the central axis 131 of the handle structure 128. A trigger 144, which is pivotally attached to the handle structure 128, is gripped by an operator to displace the spindle valve 140 to selectively configure the inlet passageway 132, outlet passageway 134, central passageway 136 and cross passageway 138 in order to extend or retract the piston 116 as described herein. The spindle valve 140 has an annular groove 143 proximate to the trigger 144. The annular groove 143 is connected to a first enlarged diameter portion 145. A second enlarged diameter portion 147 is spaced from the first enlarged diameter portion 145 by a first reduced diameter portion 149. A third enlarged diameter portion 151 is spaced from the second enlarged diameter portion 147 by a second reduced diameter portion 153. The third enlarged diameter portion 151 extends to an opposite end of the spindle valve 140. A passageway 180 extends through the spindle valve 140 and has a first opening or port 181 in the first enlarged diameter portion 145 and a second opening or port 183 in the second reduced diameter portion 153. Further description of the operation of the valve assembly 130 and the movement of the piston 116 will be provided in greater detail hereinbelow. The structure and operation of such a spindle valve 140 is well known in the art as shown in U.S. Pat. No. 5,442,992 which is assigned to the assignee of the invention disclosed and claimed herein. Additionally, U.S. Pat. No. 5,442,992 is incorporated herein by reference.

The adjustment assembly 146 is provided in the handle structure 128 to allow the control mechanism 102 to be configured for either a constant volume or a constant pressure hydraulic power source. The adjustment assembly 146 is between the valve assembly 130 and the cavity 114. The adjustment assembly 146 includes a valve chamber 148, an adjustable valve member 150, and a retaining ring 152.

The valve chamber 148 is provided in the handle structure 128 on an opposite side of the trigger 144. The valve chamber 148 is perpendicular to the central axis 131 of the handle structure 128 and always is in fluid communication with the cross passageway 138 and can be in fluid communication with the central passageway 136, depending upon the positioning of the adjustable valve member 150 and the pressure within the central passageway 136. The valve chamber 148 provides a valve seat 154 proximate to the central passageway 136.

The adjustable valve member 150 is positioned within the valve chamber 148. As best shown in FIGS. 2, 5 and 8, the adjustable valve member 150 includes a head 156, a normally expanded spring 158, an enlarged section 160, and a knob 162. The knob 162 is preferably provided proximate to an outer surface of the handle structure 128 such that a user of the hydraulic crimping tool 100 can easily operate the knob 162 by moving the knob 162 in either a first or second direction, preferably clockwise or counterclockwise. An outer end 164 of the knob 162 may have a slot 166 provided therein such that a user of the hydraulic crimping tool 100 can move the knob 162 by use of another tool, such as a screwdriver.

An outer end 168 of the enlarged section 160 is secured to an inner end 170 of the knob 162. The enlarged section 160 has a diameter which is larger than a diameter of the knob 162. Because the enlarged section 160 has a larger diameter than the knob 162, a shoulder 172 is provided between the enlarged section 160 and the knob 162. The diameter of the enlarged section 160 is preferably commensurate with a diameter of the valve chamber 148 such that any fluid provided within the valve chamber 148 cannot escape out of the valve chamber 148 and, thus, out of the hydraulic crimping tool 100.

A first end of the normally expanded spring 158 is connected to an inner end 174 of the enlarged section 160. A second end of the normally expanded spring 158 is connected to the head 156.

The head 156 is sized to fit within the valve seat 154, but may also be moved out of the valve seat 154 as will be described in greater detail herein. When the head 156 is seated in the valve seat 154, the valve seat 156 prevents the central passageway 136 from being in fluid communication with the cross passageway 138 through the valve chamber 148. If, however, the head 156 is not seated in the valve seat 154, the central passageway 136 and the cross passageway 138 are in fluid communication through the valve chamber 148.

The retaining ring 152 is provided within the valve chamber 148 and is positioned proximate to the outer surface of the handle structure 128. The retaining ring 152 has an aperture 176 therethrough which defines an inner diameter formed by the wall of the aperture 176. The inner diameter of the retaining ring 152 is larger than the diameter of the knob 162, but is smaller than the diameter of the enlarged section 160. Thus, the knob 162, upon movement thereof, can move through the aperture 176 of the retaining ring 152, but the enlarged section 160 is trapped within the valve chamber 148 as the shoulder 172 abuts against the retaining ring 152, preventing the enlarged section 160 from moving beyond the retaining ring 152. Therefore, the adjustable valve member 150 is secured within the valve chamber 148 by the retaining ring 152.

The adjustment assembly 146 provides benefits for the control mechanism 102 in comparison to the control mechanisms of the prior art. The adjustment assembly 146 utilizes a minimum number of parts and minimal manufacturing costs. The adjustment assembly 146 further is conveniently located relative to the handle 128. Thus, the adjustment assembly 146 of the control mechanism 102 provides an easy, reliable and efficient means for configuring the hydraulic crimping tool 100 for use with either a constant volume or a constant pressure system.

The tool 100 has central tube 186 which extends from the central passageway 136, through the drive chamber 124 and into the piston 116. The central tube 186 has an opening therethrough which is in fluid communication with the central passageway 136. A central chamber 184 is provided in the ram 108 and is in fluid communication with the central tube 186. A radial port 182 extends through the ram 108 and places the central chamber 184 and the retract chamber 126 into fluid communication with one another.

Operation of the hydraulic crimping tool 100 will now be discussed and attention is directed to FIGS. 1–8. Operation of the hydraulic crimping tool 100 will first be discussed where the hydraulic crimping tool 100 is employed in a constant volume or open-center hydraulic power system, as illustrated in FIGS. 1–5. Operation of the hydraulic crimping tool 100 will then be discussed where the hydraulic crimping tool 100 is employed in a constant pressure or closed-center hydraulic power system, as illustrated in FIGS. 6–8.

Attention is directed to FIGS. 1–5 and the operation of the hydraulic crimping tool 100 where the hydraulic crimping tool 100 is employed in a constant volume or open-center hydraulic power system. In order to operate the hydraulic crimping tool 100 such that the hydraulic crimping tool 100 is employed in a constant volume or open-center hydraulic system, the user first rotates the knob 162 of the adjustable valve member 150 in a first direction, preferably counter-clockwise, until the shoulder 172 of the enlarged section 160 contacts the retaining ring 152, as illustrated in FIGS. 1–5. In this position, the spring 158 is expanded such that the head 156 is seated in the valve seat 154, as best illustrated in FIG. 5. The knob 162 may extend out of the handle structure 128 in this position.

Figure 3:
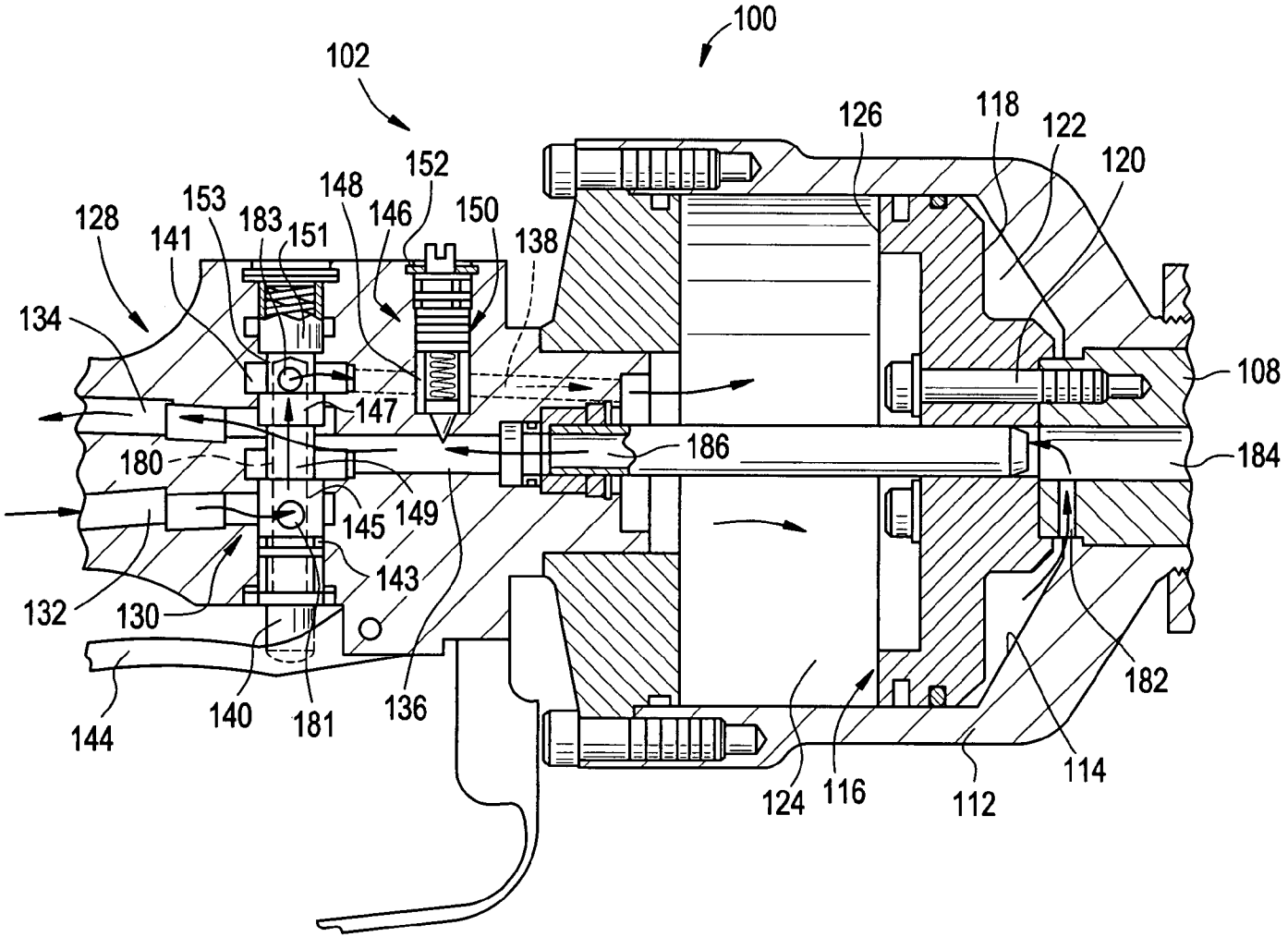
FIG. 3 is an enlarged, partial fragmentary, cross-sectional view showing the control mechanism of the crimping tool as shown in FIG. 1 in the trigger activated condition in which the crimping ram is advanced by hydraulic forces acting on the reciprocal piston of the control mechanism.

In order to provide crimping forces on a crimp connection placed in the C-shaped aperture 110, the user activates the trigger 144 by moving the trigger 144 toward the handle structure 128, as illustrated in FIG. 3. When the trigger 144 is in the position illustrated in FIG. 3, the spindle valve 140 places the inlet passageway 132 into fluid communication with the cross passageway 138, via the passageway 180 through the spindle valve 140, with the first opening 181 being in fluid communication with the inlet passageway 132 and the second opening 183 being in fluid communication with the cross passageway 138. The spindle valve 140 also places the central passageway 136 into fluid communication with the outlet passageway 134 as fluid is allowed to travel into the spindle valve chamber 141 and around the reduced diameter section 149 of the spindle valve 140. Thus, hydraulic fluid from the reservoir (not shown) of a hydraulic power system flows into the inlet passageway 132, into the first port 181, through the passageway 180 of the spindle valve 140, out of the second port 183, into the cross passageway 138, and into the drive chamber 124. The hydraulic fluid flowing through the central passageway 136 is prevented from flowing directly into the cross passageway 138 via the valve chamber 148 because the head 156 is seated within the valve seat 154 and the spring 158 is expanded, i.e., the force of the fluid within the central passageway 136 is not sufficient to force the spring 158 to contract such that the head 156 will be unseated from the valve seat 154, allowing the hydraulic fluid flowing through the central passageway 136 to flow straight into the valve chamber 148 and back into the cross passageway 138.

As the amount of fluid in the drive chamber 124 increases, the pressure within the drive chamber 124 also increases, such that the driving piston 116 is advanced axially through the cavity 114. The advancement of the driving piston 116 through the cavity 114 axially advances the ram 108 thereby crimping a crimp connection placed in the C-shaped aperture 110. Advancement of the driving piston 116 through the cavity 114 forces hydraulic fluid from the retract chamber 122 through the radial passageways 182, into and through the central chamber 184, into and through the central tube 186, into the spindle valve chamber 141, around the reduced diameter section 149 of the spindle valve 140, into and through the outlet passageway 134, and into the reservoir.

Figure 4:
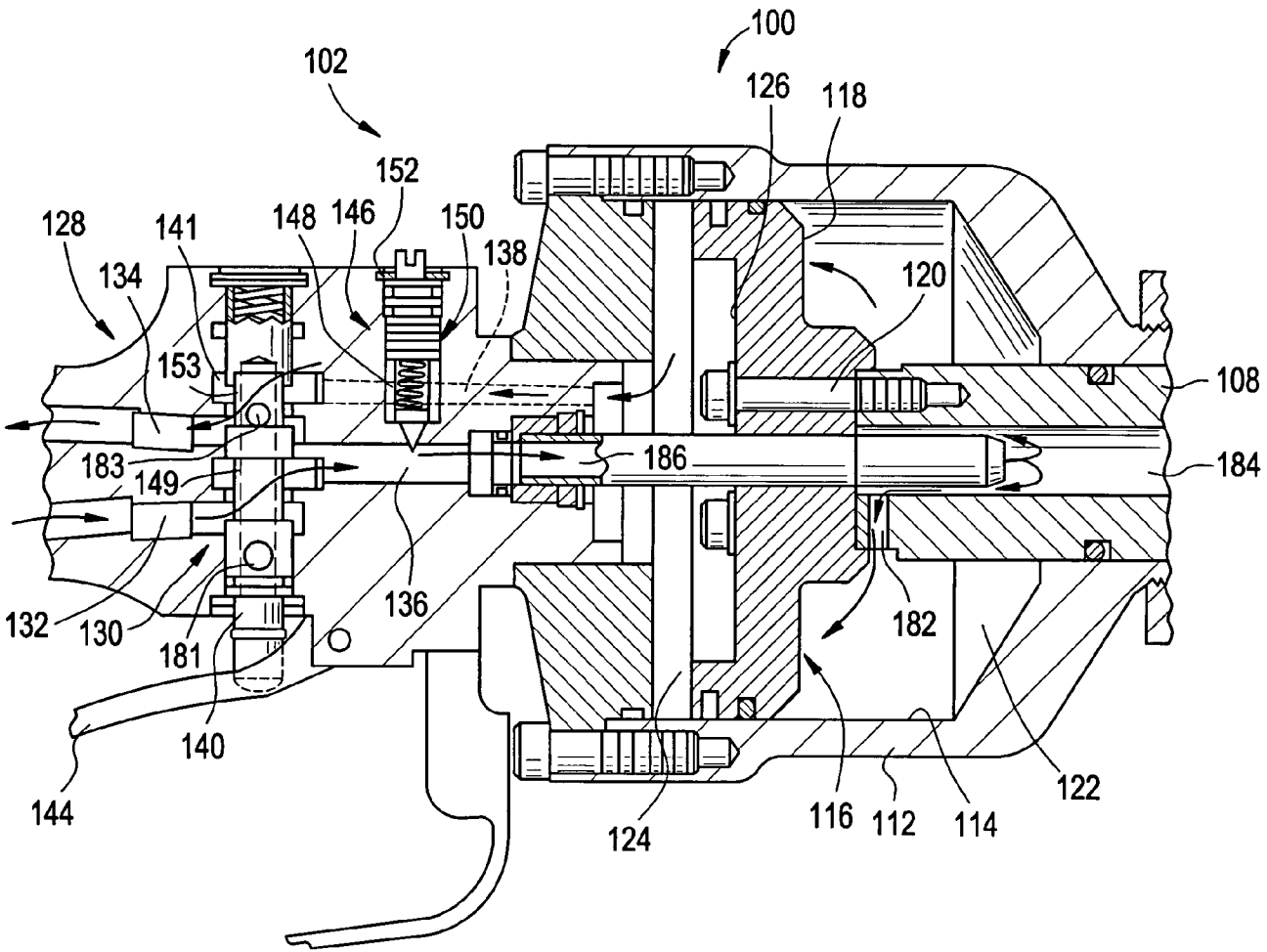
FIG. 4 is an enlarged, partial fragmentary, cross-sectional view showing the control mechanism of the crimping tool as shown in FIG. 1 in the trigger deactivated condition in which the crimping ram is retracted by hydraulic forces acting on the reciprocal piston of the control mechanism.

Once the crimping forces on the crimp connection are made, the user releases the trigger 144 such that it moves to the position illustrated in FIG. 4. As illustrated in FIG. 4, the release of the trigger 144 causes the inlet passageway 132 to not be in fluid communication with the cross passageway 138 through the passageway 180 of the spindle valve 140. Rather, the inlet passageway 132 is placed into fluid communication with the central passageway 136 because of the positioning of the spindle valve 140 within the spindle valve chamber 141, and the cross passageway 138 is placed into fluid communication with the outlet passageway 134 because of the positioning of the spindle valve 140 within the spindle valve chamber 141. Thus, the hydraulic fluid from the reservoir flows into and through the inlet passageway 132, into the spindle valve chamber 141, around the reduced diameter section 149 of the spindle valve 140, into and through the central passageway 136, into and through the central tube 186, into and through the central chamber 184, into and through the radial passageways 182, and into the retract chamber 122. The hydraulic fluid flowing through the central passageway 132 is prevented from flowing directly into the cross passageway 134 via the valve chamber 148 because the head 156 is seated within the valve seat 154 and the spring 158 is expanded, i.e., the force of the fluid within the central passageway 136 is not sufficient to force the spring 158 to contract such that the head 156 will be unseated from the valve seat 154, allowing the hydraulic fluid flowing through the central passageway 136 to flow straight into the valve chamber 148 and back into the cross passageway 138.

As the amount of fluid in the retract chamber 122 increases, the pressure within the retract chamber 122 also increases, such that the driving piston 116 is axially retracted within the cavity 114. The driving piston 116 retracting within the cavity 114 causes ram 108 to axially retract and the crimping forces on the crimp connection to be stopped. Retraction of the driving piston 116 within the cavity 114 causes the hydraulic fluid within the driving chamber 124 to flow out of the driving chamber 124, into and through the cross passageway 138, into the spindle valve chamber 141, around the reduced diameter section 153 of the spindle valve 140, into and through the outlet passageway 134, and back into the reservoir.

When the driving piston 116 is retracting within the cavity 114, the driving piston 116 will come to a fully retracted position, as illustrated in FIG. 1. Because the driving piston 116 cannot be retracted further, and because the hydraulic fluid continues to fill in the retract chamber 122 such that the pressure is increased within the retract chamber 122, the back pressure provided within the central passageway 136 is such that it overcomes the strength of the spring 158 which holds the head 156 in the valve seat 154. Thus, the spring 158, at a predetermined pressure, contracts within the valve chamber 148 such that the head 156 becomes unseated from the valve seat 154, as illustrated in FIGS. 1 and 2. Thus, in order to alleviate the pressure within the retract chamber 122, the hydraulic fluid flows from the inlet passageway 132, into the spindle valve chamber 141, around the reduced diameter section 149 of the spindle valve 140, into the central passageway 136, into the valve chamber 148, into the cross passageway 138, back into the spindle valve chamber 141, around the reduced diameter section 153 of the spindle valve 140, into and through the outlet passageway 134, and into the reservoir. This is the neutral position of a constant volume system which allows fluid to continuously flow from the inlet passageway 132 through the adjustment assembly 146 of the control mechanism 102, and back through the outlet passageway 134. In this position, the pressure in the retract chamber 122 and the drive chamber 124 is generally equalized such that the hydraulic fluid will continuously flow through the adjustment assembly 146 of the control mechanism 122 until the user again activates the trigger 144.

Attention is directed to FIGS. 6–8 and the operation of the hydraulic crimping tool 100 where the hydraulic crimping tool 100 is employed in a constant pressure or closed-center hydraulic power system. In order to operate the hydraulic crimping tool 100 such that the hydraulic crimping tool 100 is employed in a constant pressure or closed-center hydraulic system, the user first rotates the knob 162 of the adjustable valve member 150 in a second direction, preferably clockwise, until the head 156 is fully seated within the valve seat 154. The head 156 is fully seated within the valve seat 154 when the normally expanded spring 158 is fully contracted, as best illustrated in FIG. 8.

In order to provide crimping forces on a crimp connection placed in the C-shaped aperture 110, the user activates the trigger 144 by moving the trigger 144 toward the handle structure 128, as illustrated in FIG. 7. When the trigger 144 is in the position illustrated in FIG. 7, the spindle valve 140 places the inlet passageway 132 into fluid communication with the cross passageway 138, via the passageway 180. The spindle valve 140 also places the central passageway 136 into fluid communication with the outlet passageway 134 as fluid is allowed to travel within the spindle valve chamber 141 around the reduced diameter section 149 of the spindle valve 140. Thus, hydraulic fluid from the reservoir (not shown) of a hydraulic power system flows into the inlet passageway 132, through the passageway 180 of the spindle valve 140, into the cross passageway 138, and into the drive chamber 124. The hydraulic fluid flowing through the inlet passageway 132 is prevented from flowing directly from the valve chamber 148 into the outlet passageway 134 because the head 156 is fully seated within the valve seat 154.

As the amount of fluid in the drive chamber 124 increases, the pressure within the drive chamber 124 also increases, such that the driving piston 116 is advanced through the cavity 114. The advancement of the driving piston 116 through the cavity 114 causes the ram 108 to axially advance and the crimping forces on a crimp connection placed in the C-shaped aperture 110. Advancement of the driving piston 116 through the cavity 114 forces hydraulic fluid from the retract chamber 122 through the radial passageways 182, into and through the central chamber 184, into and through the central tube 186, into the spindle valve chamber 141, around the reduced diameter section 149 of the spindle valve 140, into and through the outlet passageway 134, and into the reservoir.

Once the crimping forces on the crimp connection are made, the user releases the trigger 144 such that it moves to the position illustrated in FIG. 6. As illustrated in FIG. 6, the release of the trigger 144 causes the inlet passageway 132 to not be in fluid communication with the cross passageway 138 through the passageway 180 of the spindle valve 140. Rather, the inlet passageway 132 is placed into fluid communication with the central passageway 136 because of the positioning of the spindle valve 140 within the spindle valve chamber 141, and the cross passageway 138 is placed into fluid communication with the outlet passageway 134 because of the positioning of the spindle valve 140 within the spindle valve chamber 141. Thus, the hydraulic fluid from the reservoir flows into and through the inlet passageway 132, into the spindle valve chamber 141, around the reduced diameter section 149 of the spindle valve 140, into and through the central passageway 136, into and through the central tube 186, into and through the central chamber 184, into and through the radial passageways 182, and into the retract chamber 122. The hydraulic fluid flowing through the inlet passageway 132 is prevented from flowing from the valve chamber 148 directly into the outlet passageway 134 because the head 156 is fully seated within the valve seat 154.

As the amount of fluid in the retract chamber 122 increases, the pressure within the retract chamber 122 also increases, such that the driving piston 116 is retracted within the cavity 114. The driving piston 116 retracting within the cavity 114 causes the ram 108 to axially retract and the crimping forces on the crimp connection to be stopped. Retraction of the driving piston 116 within the cavity 114 causes the hydraulic fluid within the driving chamber 124 to flow out of the driving chamber 124, into and through the cross passageway 138, into the spindle valve chamber 141, around the reduced diameter section 153 of the spindle valve 140, into and through the outlet passageway 134, and back into the reservoir.

Once the driving piston 116 comes to a fully retracted position, because the hydraulic fluid continues to fill in the retract chamber 122, pressure will continue to build within the cavity 114. Because the head 156 is mechanically locked in the valve seat 154, such that hydraulic fluid is not allowed to flow past the head 156, pressure will continue to build until it reaches a predetermined value established by a relief valve (not shown) in the hydraulic circuit. Relief valves within hydraulic circuits are well-known in the art and, therefore, are not explained herein in detail. In systems with a positive displacement pump, the relief valve diverts flow back to the reservoir. On systems with a variable stroking pump, pressure will continue to build until it reaches the predetermined value established by the relief valve, whose control system then reduces the flow of hydraulic fluid to adequately maintain system pressure.

In the constant pressure system, the force of the fluid within the central passageway 136 is never sufficient to unseat the head 156 from the valve seat 154 as the spring 158 is already fully contracted. Thus, the hydraulic fluid will never flow directly or continuously from the central passageway 136, into the valve chamber 148, and back into the cross passageway 138.

Utility Pruner Tool 300 Having The Novel Control Mechanism 302

Figure 9:
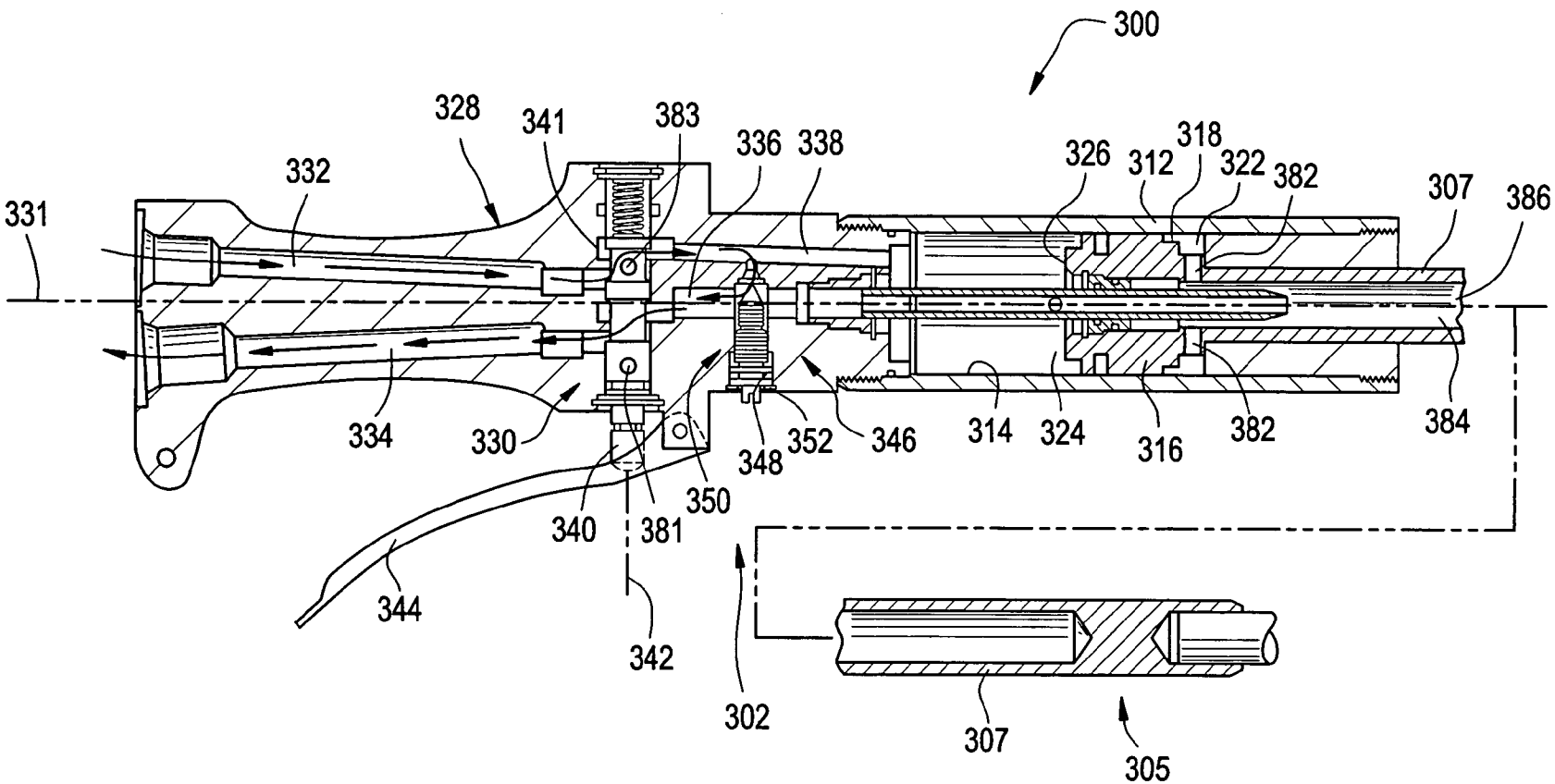
FIG. 9 is a partial fragmentary, cross-sectional view of a hydraulic utility pruner tool which incorporates features in accordance with a second embodiment of the claimed invention which is configured for use with a constant volume or "open-center" hydraulic power system in which a reciprocal piston and an extension rod attached thereto are in an extended or advanced position with the system in a neutral condition.
Figure 10:
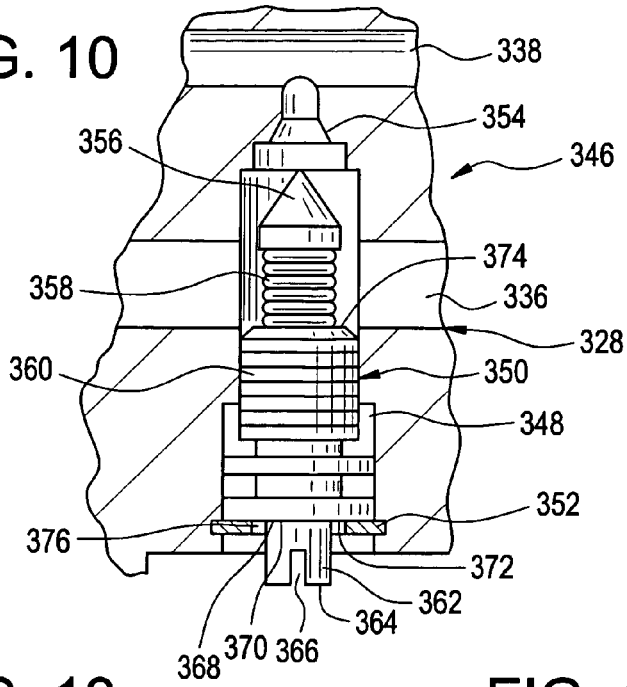
FIG. 10 is an enlarged, partial fragmentary, cross-sectional view of an adjustment assembly of the hydraulic utility pruner tool illustrated in FIG. 9.
Figure 13:
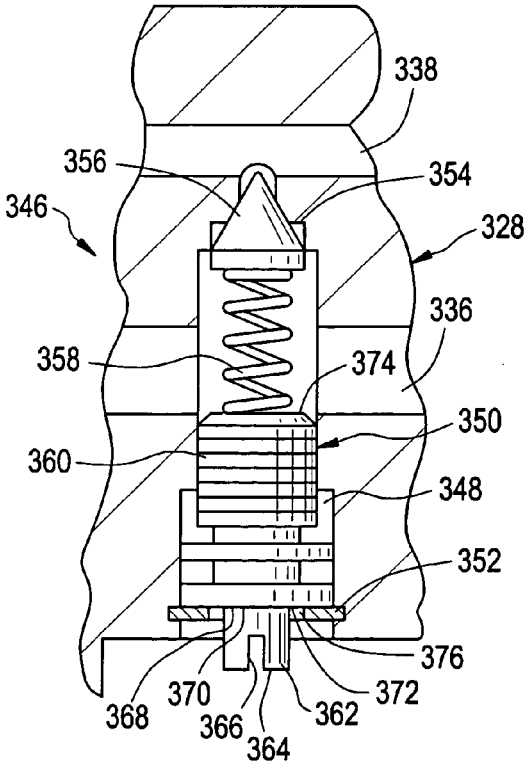
FIG. 13 is an enlarged, partial fragmentary, cross-sectional view of the adjustment assembly of the hydraulic utility pruner tool illustrated in FIGS. 11 and 12.
Figure 16:
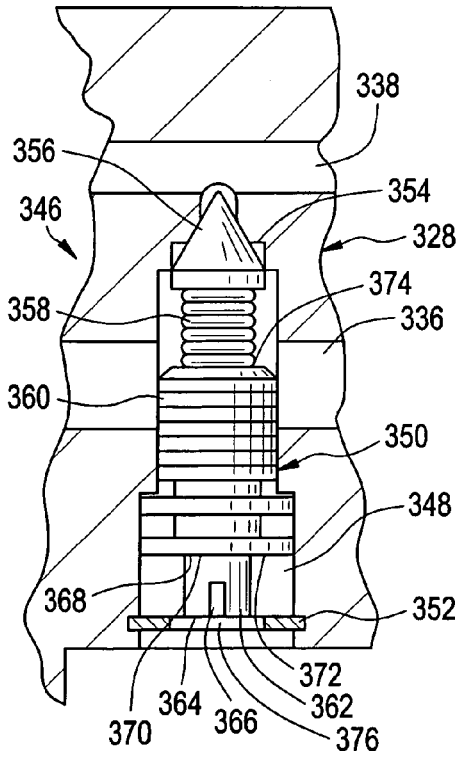
FIG. 16 is an enlarged, partial fragmentary, cross-sectional view of the adjustment assembly of the hydraulic utility pruner tool illustrated in FIGS. 14 and 15.
Figure 14:
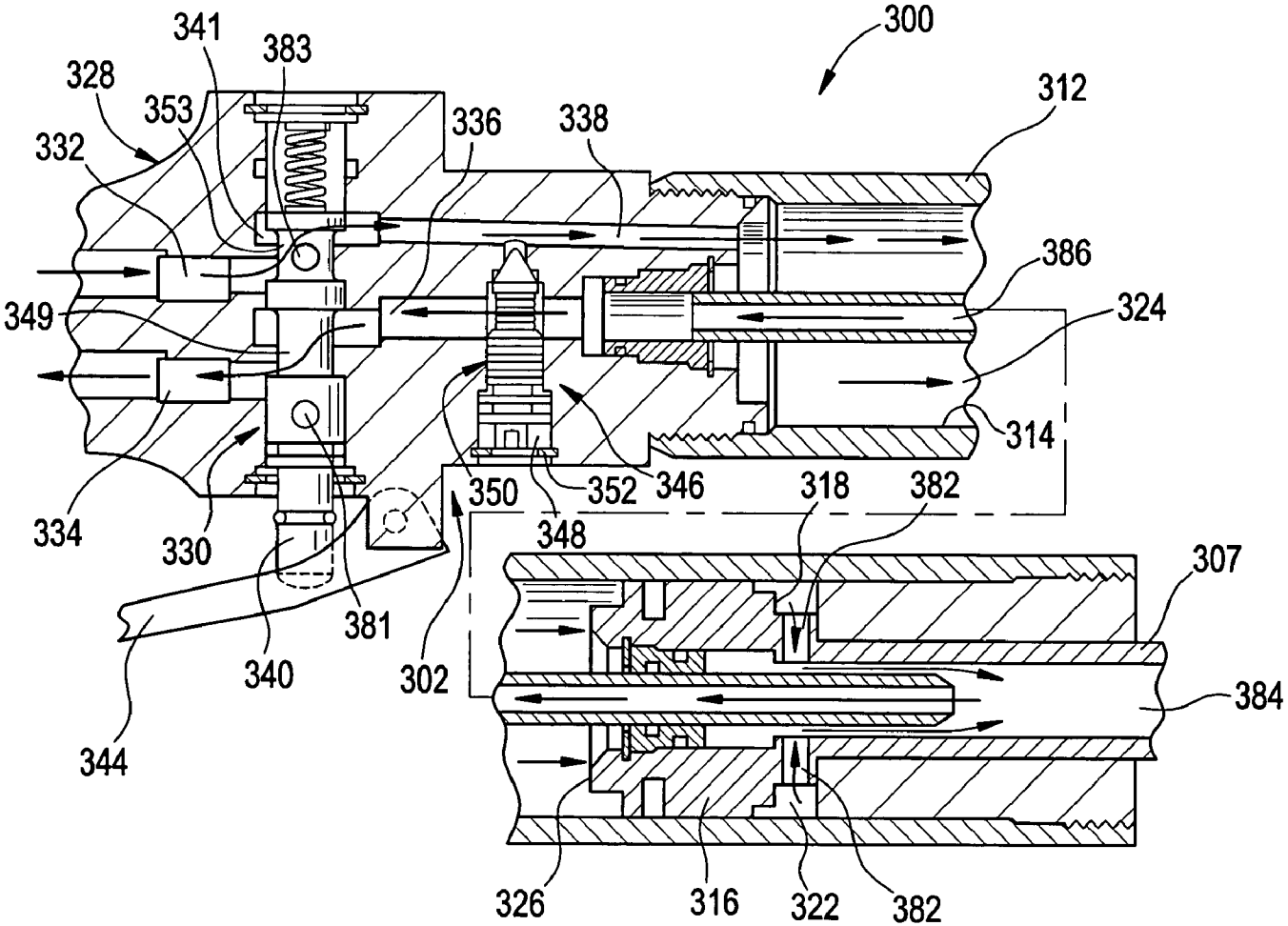
FIG. 14 is an enlarged, partial fragmentary, cross-sectional view of the utility pruner tool as shown in FIGS. 9–13 which has been configured for operation with a constant pressure or "closed-center" hydraulic power system in the trigger activated condition in which the piston and extension rod are in a retracted position.
Figure 15:
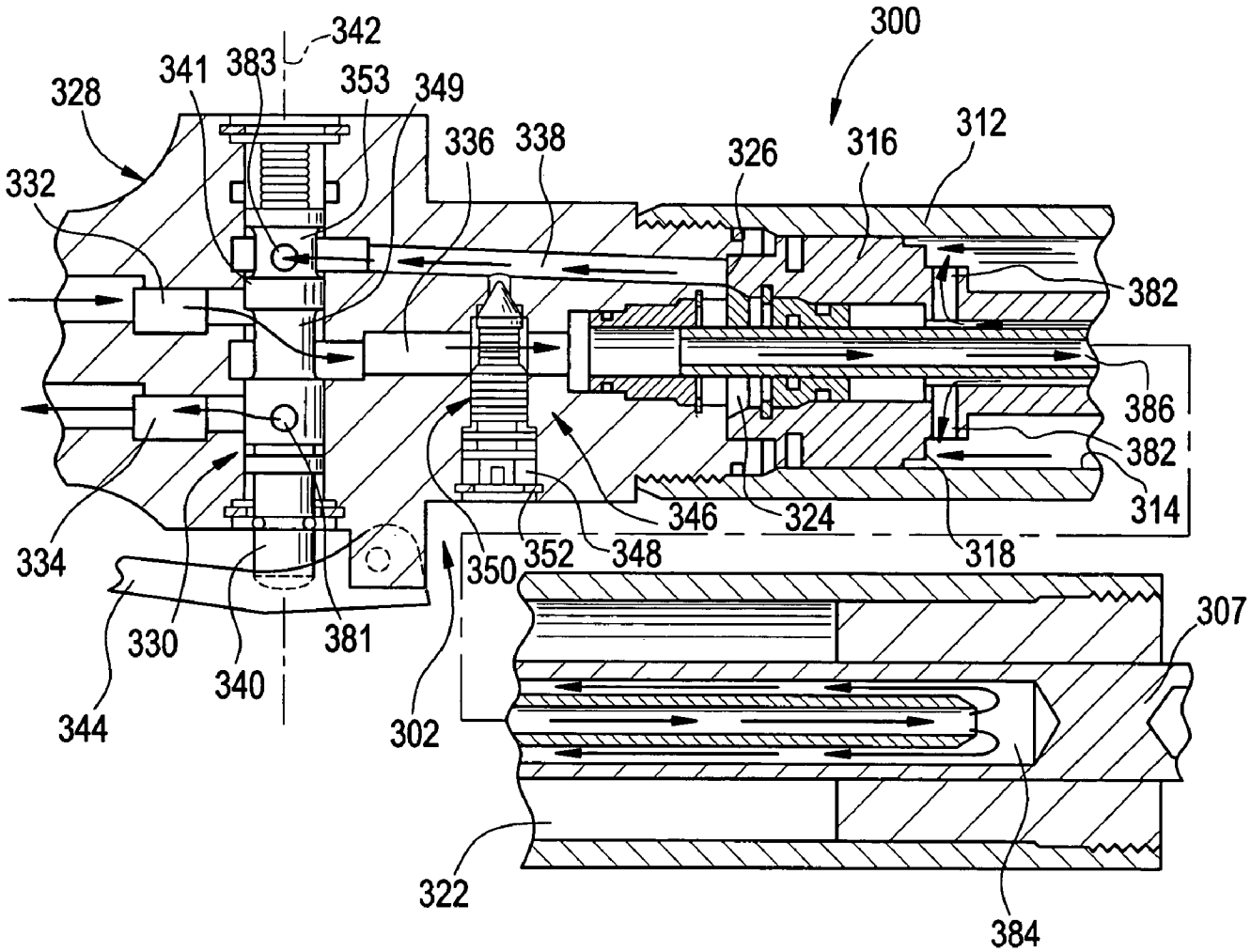
FIG. 15 is an enlarged, partial fragmentary, cross-sectional view showing the control mechanism of the utility pruner tool as shown in FIG. 14 in the trigger deactivated condition in which the extension rod is extended or advanced by hydraulic forces acting on the reciprocal piston of the control mechanism.

FIGS. 9–13 show the control mechanism 302 of the utility pruner tool 300 employed with a constant volume or open-center hydraulic power system, whereas FIGS. 14–16 show the control mechanism 302 of the utility pruner tool 300 employed with a constant pressure or closed-center hydraulic power system. FIGS. 9, 11, 12, 14 and 15 have been substantially enlarged to show only a portion of the utility pruner tool 300 which includes the control mechanism 302 of the utility pruner tool 300. FIGS. 10, 13 and 16 illustrate enlarged views of the control mechanism 302, specifically illustrating an adjustment assembly 346 of the control mechanism 302.

The hydraulic utility pruner tool 300 includes an extension rod assembly unit 305 having an extension rod 307 which is operatively associated with cutting blades (not shown) of the hydraulic utility pruner tool 300. The extension rod assembly unit 305 is attached to the control mechanism 302 to provide reciprocal movement of the extension rod 307. Movement of the extension rod 307 provides for the opening and closing of the cutting blades. The control mechanism 302 regulates hydraulic forces to advance and retract the extension rod 307 to provide a desired cutting effect on items positioned between the cutting blades. It should be understood that the control mechanism 302 may also be used with a variety of other hydraulic tools which require the ability to be used with either an open-center or a closed-center hydraulic power system. The present disclosure is illustrated by way of reference to the utility pruner tool 300 as shown herein but is not limited to the utility pruner tool 300.

As shown in each of FIGS. 9, 11, 12, 14 and 15, the control mechanism 302 includes a housing 312 defining a cavity 314 therein with a reciprocal piston or driving piston 316 retained in the cavity 314 for movement toward and away from the cutting blades. The extension rod 307 is attached to a first side 318 of the piston 316 by suitable means, but the extension rod 307 is preferably integrally formed with the piston 316.

The piston 316 divides the cavity 314 into a retract chamber 322 and a drive chamber 324. The retract chamber 322 is defined between the first side 318 of the piston 316 and the corresponding walls which devine the cavity 314 in the housing 312. The drive chamber 324 is similarly defined between a second side 326 of the piston 316 and corresponding walls which define the cavity 314 in the housing 312.

The control mechanism 302 includes a handle structure 328 containing a valve assembly 330. The handle structure 328 is defined about a central axis 331. An inlet passageway 332 and an outlet passageway 334 extend axially through the handle structure 328 for connection to a hydraulic power system (not shown) of a known construction. The inlet passageway 332 extends along one side of the central axis 331 while the outlet passageway 334 extends along another side of the central axis 331. The inlet passageway 332 and the outlet passageway 334 can be connected to either the constant volume or constant pressure system. A central passageway 336 extends axially within the handle structure 328 along the central axis 331 and selectively connects either the inlet passageway 332 or the outlet passageway 334 via the valve assembly 330 with the retract chamber 322 as will be described in greater detail hereinbelow. A cross passageway 338 extends axially within the handle structure 328, on the same side of the central axis 331 as the inlet passageway 334, and selectively connects either the inlet passageway 332 or the outlet passageway 334 via the valve assembly 330 with the drive chamber 324 as will be described in greater detail hereinbelow.

The valve assembly 330 includes a spindle valve 340 which is axially displaceable within a spindle valve chamber 341 along a spindle axis 342. The spindle axis 342 is perpendicular to the central axis 331 of the handle structure 328. A trigger 344, which is pivotally attached to the handle structure 328, is gripped by an operator to displace the spindle valve 340 to selectively configure the inlet passageway 332, outlet passageway 334, central passageway 336 and cross passageway 338 in order to extend or retract the piston 316 as described herein. The spindle valve 340 has an annular groove 343 proximate to the trigger 344. The annular groove 343 is connected to a first enlarged diameter portion 345. A second enlarged diameter portion 347 is spaced from the first enlarged diameter portion 345 by a reduced diameter portion 349. A third enlarged diameter portion 351 is spaced from the second enlarged diameter portion 347 by a second reduced diameter portion 353. The third enlarged diameter portion 351 extends to an opposite end of the spindle valve 340. A passageway 380 extends through the spindle valve 340 and has a first opening or port 381 in the first enlarged diameter portion 345 and a second opening or port 383 in the second reduced diameter portion 353. Further description of the operation of the valve assembly 330 and the movement of the piston 316 will be provided in greater detail hereinbelow. The structure and operation of such a spindle valve 340 is well known in the art as shown in U.S. Pat. No. 5,442,992 which is assigned to the assignee of the invention disclosed and claimed herein. Additionally, U.S. Pat. No. 5,442,992 is incorporated herein by reference. An adjustment assembly 346 is provided in the handle structure 328 to allow the control mechanism 302 to be configured for either a constant volume or a constant pressure hydraulic power source. The adjustment assembly 346 is between the valve assembly 330 and the cavity 314. The adjustment assembly 346 includes a valve chamber 348, an adjustable valve member 350, and a retaining ring 352.

The valve chamber 348 is provided in the handle structure 328 on the same side as is the trigger 344. The valve chamber 348 is perpendicular to the central axis 131 of the handle structure 328 and is always in fluid communication with the central passageway 336 and can be in fluid communication with the cross passageway 338, depending upon the positioning of the adjustable valve member 350 and the pressure within the cross passageway 338. The valve chamber 348 provides a valve seat 354 proximate to the cross passageway 338.

The adjustable valve member 350 is positioned within the valve chamber 348. As best shown in FIGS. 10, 13 and 16, the adjustable valve member 350 includes a valve 356, a normally expanded spring 358, an enlarged section 360, and a knob 362. The knob 362 is preferably provided proximate to an outer surface of the handle structure 328 such that a user of the hydraulic utility pruner tool 300 can easily operate the knob 362 by moving the knob 362 in either a first or second direction, preferably clockwise, or counterclockwise. An outer end 364 of the knob 362 may have a slot 366 provided therein such that a user of the hydraulic utility pruner tool 300 can move the knob 362 by use of another tool, such as a screwdriver.

An outer end 368 of the enlarged section 360 is secured to an inner end 370 of the knob 362. The enlarged section 360 has a diameter which is larger than a diameter of the knob 362. Because the enlarged section 360 has a larger diameter than the knob 362, a shoulder 372 is provided between the enlarged section 360 and the knob 362. The diameter of the enlarged section 360 is preferably commensurate with a diameter of the valve chamber 348 such that any fluid provided within the valve chamber 348 cannot escape out of the valve chamber 348 and, thus, out of the hydraulic utility pruner tool 300.

A first end of the normally expanded spring 358 is connected to an inner end 374 of the enlarged section 360. A second end of the normally expanded spring 358 is connected to the valve 356.

The valve 356 is sized to fit within the valve seat 354, but may also be moved out of the valve seat 354 as will be described in greater detail herein. When the valve 356 is seated in the valve seat 354, the valve 356 prevents the cross passageway 338 from being in fluid communication with the central passageway 336 through the valve chamber 348. If, however, the valve 356 is not seated in the valve seat 354, the cross passageway 338 and the central passageway 336 are in fluid communication through the valve chamber 348.

The retaining ring 352 is provided within the valve chamber 348 and is positioned proximate to the outer surface of the handle structure 328. The retaining ring 352 has an aperture 376 therethrough which defines an inner diameter formed by the wall of the aperture 376. The inner diameter of the retaining ring 352 is larger than the diameter of the knob 362, but is smaller than the diameter of the enlarged section 360. Thus, the knob 362, upon movement thereof, can move through the aperture 376 of the retaining ring 352, but the enlarged section 360 is trapped within the valve chamber 348 as the shoulder 372 abuts against the retaining ring 352, preventing the enlarged section 360 from moving beyond the retaining ring 352. Therefore, the adjustable valve member 350 is secured within the valve chamber 348 by the retaining ring 352.

The adjustment assembly 346 provides benefits for the control mechanism 302 in comparison to the control mechanism of the prior art. The adjustment assembly 346 utilizes a minimum number of parts and minimal manufacturing costs. The adjustment assembly 346 further is conveniently located relative to the handle 328. Thus, the adjustment assembly 346 of the control mechanism 302 provides an easy, reliable and efficient means for configuring the hydraulic utility pruner tool 300 for use with either a constant volume or a constant pressure system.

The tool 300 has a central tube 386 which extends from the central passageway 336, through the drive chamber 324 and into the piston 316. The central tube 386 has an opening threthrough which is in fluid communication with the central passageway 336. A central chamber 384 is provided in the ram 308 and is in fluid communication with the central tube 386. A radial port 382 extends through the ram 308 and places the central chamber 384 and the retract chamber 326 into fluid communication with one another.

Operation of the hydraulic utility pruner tool 300 will now be discussed and attention is directed to FIGS. 9–16. Operation of the hydraulic utility pruner tool 300 will first be discussed where the hydraulic utility pruner tool 300 is employed in a constant volume or open-center hydraulic power system, as illustrated in FIGS. 9–13. Operation of the hydraulic utility pruner tool 300 will then be discussed where the hydraulic utility pruner tool 300 is employed in a constant pressure or closed-center hydraulic power system, as illustrated in FIGS. 14–16.

Attention is directed to FIGS. 9–13 and the operation of the hydraulic utility pruner tool 300 where the hydraulic utility pruner tool 300 is employed in a constant volume or open-center hydraulic power system. In order to operate the hydraulic utility pruner tool 300 such that the hydraulic utility pruner tool 300 is employed in a constant volume or open-center hydraulic system, the user first rotates the knob 362 of the adjustable valve member 350 in a first direction, preferably counterclockwise, until the shoulder 372 of the enlarged section 360 contacts the retaining ring 352, as illustrated in FIGS. 9–13. In this position, the spring 358 is expanded such that the valve 356 is seated in the valve seat 354, as best illustrated in FIG. 13. The knob 362 may extend out of the handle portion 328 in this position.

Figure 11:
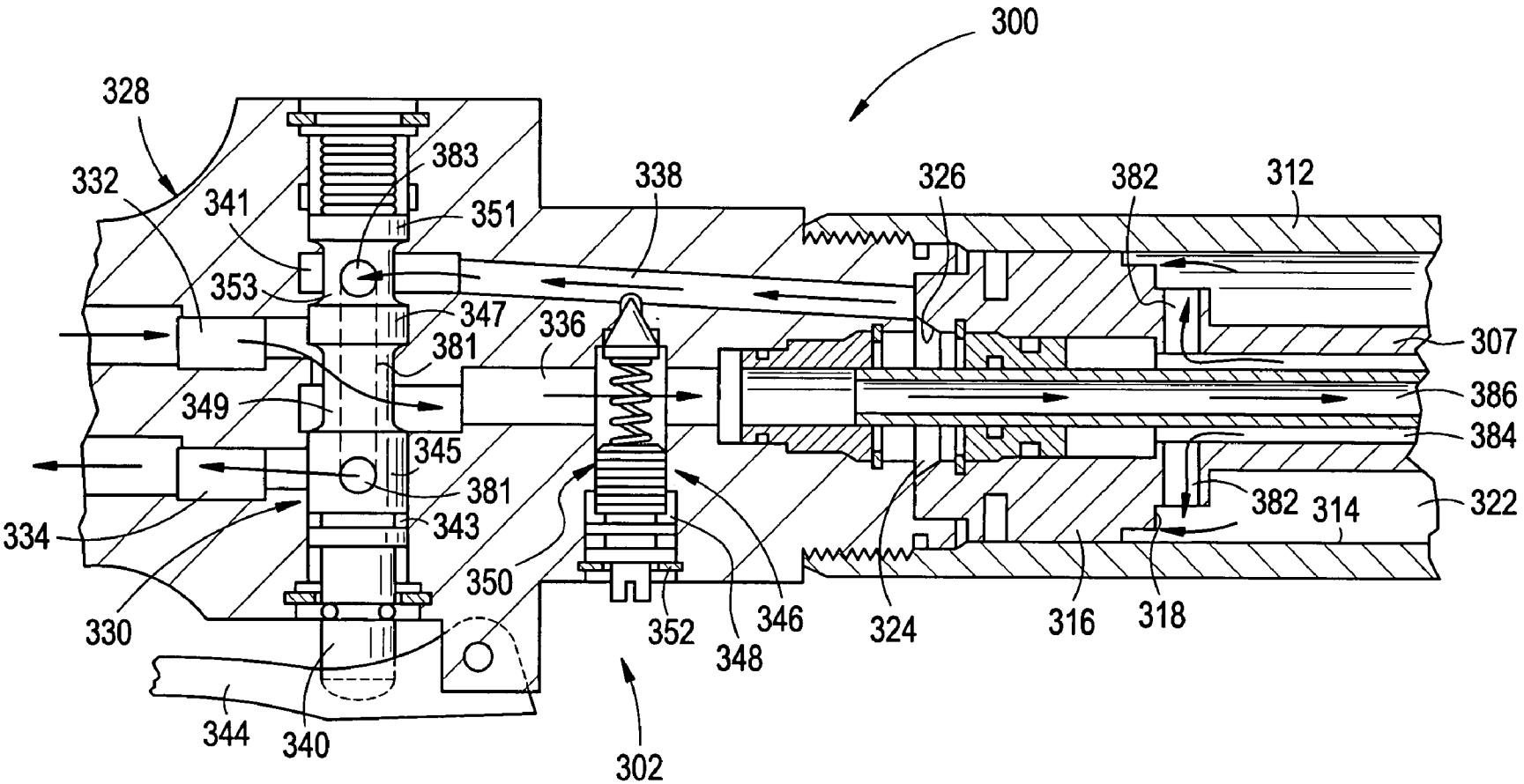
FIG. 11 is an enlarged, partial fragmentary, cross-sectional view showing the control mechanism of the utility pruner tool as shown in FIG. 9 in the trigger activated condition in which the extension rod is retracted by hydraulic forces acting on the reciprocal piston of the control mechanism.

In order to close the cutting blades, the user activates the trigger 344 by moving the trigger 344 toward the handle structure 328, as illustrated in FIG. 11. When the trigger 344 is in the position illustrated in FIG. 11, the inlet passageway 332 is not in fluid communication with the cross passageway 338. Rather, the inlet passageway 332 is placed into fluid communication with the central passageway 336 because of the positioning of the spindle valve 340 within the spindle valve chamber 341, and the cross passageway 338 is placed into fluid communication with the outlet passageway 334 through the passageway 380 of the spindle valve 340, because of the positioning of the spindle valve 340 within the spindle valve chamber 341. Thus, the hydraulic fluid from the reservoir flows into and through the inlet passageway 332, into the spindle valve chamber 341, around the reduced diameter portion 349 of the spindle valve 340, into and through the central passageway 336, into and through the central tube 386, into and through the central chamber 384, into and through the radial passageways 382, and into the retract chamber 322.

As the amount of fluid in the retract chamber 322 increases, the pressure within the retract chamber 322 also increases, such that the driving piston 316 is caused to retract within the cavity 314. The driving piston 316 retracting within the cavity 314 causes the extension rod 307 to retract which, in turn, causes the cutting blades to close, such that the article to be cut by the cutting blades is cut. Retraction of the driving piston 316 within the cavity 314 causes the hydraulic fluid within the driving chamber 324 to flow out of the driving chamber 324, into and through the cross passageway 338, into the second port 383, through the passageway 380 of the spindle valve 340, out of the first port 381, into and through the outlet passageway 334, and back into the reservoir. The hydraulic fluid flowing through the cross passageway 338 to the outlet passageway 334 is prevented from flowing directly into the central passageway 336 to the inlet passageway 332 via the valve chamber 348 because the valve 356 is seated within the valve seat 354 and the spring 358 is expanded, i.e., the force of the fluid within the cross passageway 338 is not strong enough to force the spring 358 to contact such that the valve 356 will be unseated from the valve seat 354, allowing the hydraulic fluid flowing through the cross passageway 338 to flow straight into the valve chamber 354 and back into the central passageway 336 and the inlet passageway 332.

Figure 12:
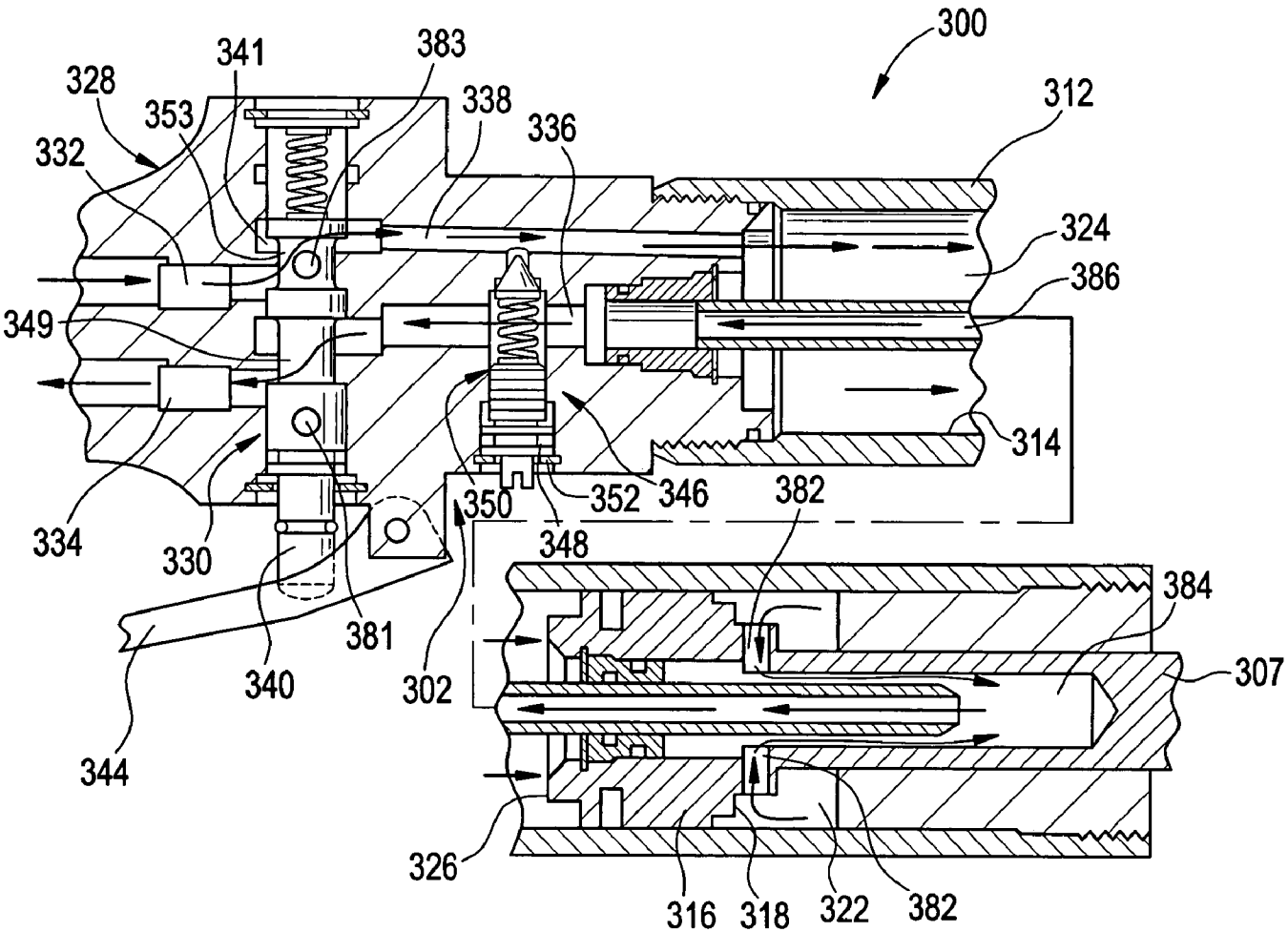
FIG. 12 is an enlarged, partial fragmentary, cross-sectional view showing the control mechanism of the utility pruner tool as shown in FIG. 9 in the trigger deactivated condition in which the extension rod is extended or advanced by hydraulic forces acting on the reciprocal piston of the control mechanism.

Once a cut is made with the cutting blades, the user deactivates or releases the trigger 344 by moving the trigger 344 away from the handle structure 328, as illustrated in FIG. 12. When the trigger 344 is in the position illustrated in FIG. 12, the spindle valve 340 places the inlet passageway 332 into fluid communication with the cross passageway 338 as fluid is allowed to travel into the spindle valve chamber 341 and around the reduced diameter portion 353 of the spindle valve 340. The spindle valve 340 also places the outlet passageway 334 into fluid communication with the central passageway 336 as fluid is allowed to travel into the spindle valve chamber 341 and around the reduced diameter portion 349 of the spindle valve 340.

Thus, hydraulic fluid from the reservoir (not shown) of a hydraulic power system flows into the inlet passageway 332, into the spindle valve chamber 341, around the reduced diameter portion 353 of the spindle valve 340, into and through the cross passageway 338, and into the drive chamber 324. The hydraulic fluid flowing through the cross passageway 338 is prevented from flowing directly into the central passageway 336 via the valve chamber 348 because the valve 356 is seated within the valve seat 354 and the spring 358 is expanded, i.e., the force of the fluid within the cross passageway 338 is not sufficient to force the spring 358 to contract such that the valve 356 will be unseated from the valve seat 354, allowing the hydraulic fluid flowing through the cross passageway 336 to flow straight into the valve chamber 348 and back into the central passageway 336.

As the amount of fluid in the drive chamber 324 increases, the pressure within the drive chamber 324 also increases, such that the driving piston 316 is caused to advance through the cavity 314. The advancement of the driving piston 316 through the cavity 314 causes the extension rod 307 to advance such that the cutting blades are opened. Advancement of the driving piston 316 through the cavity 314 forces hydraulic fluid from the retract chamber 322 through the radial passageways 382, into and through the central chamber 384, into and through the central tube 386, into the spindle valve chamber 341, around the reduced diameter portion 349 of the spindle valve 340, into and through the outlet passageway 334, and into the reservoir.

When the driving piston 316 is advancing within the cavity 314, the driving piston 316 will come to a fully advanced position, as illustrated in FIG. 9. Because the driving piston 316 cannot be further advanced, and because the hydraulic fluid continues to fill in the drive chamber 324 such that the pressure is increased within the drive chamber 324, the back pressure provided within the cross passageway 338 is such that it overcomes the strength of the spring 358 which holds the valve 356 in the valve seat 354. Thus, the spring 358, at a predetermined pressure, contracts within the valve chamber 348 such that the valve 356 becomes unseated from the valve seat 354, as illustrated in FIGS. 9 and 10. Thus, in order to alleviate the pressure within the drive chamber 324, the hydraulic fluid flows from the inlet passageway 332, into the spindle valve chamber 341, around the reduced diameter portion 353 of the spindle valve 340, into the cross passageway 338, into the valve chamber 348, into the central passageway 336, back into the spindle valve chamber 341, around the reduced diameter portion 349 of the spindle valve 340, into and through the outlet passageway 334, and into the reservoir. This is the neutral position of a constant volume system which allows fluid to continuously flow from the inlet passageway 332, through the adjustment assembly 346 of the control mechanism 302, and back through the outlet passageway 334. In this position, the pressure in the drive chamber 324 and the retract chamber 322 is generally equalized such that the hydraulic fluid will continuously flow through the adjustment assembly 346 of the control mechanism 322 until the user again activates the trigger 344.

Attention is directed to FIGS. 14–16 and the operation of the hydraulic utility pruner tool 300 where the hydraulic utility pruner tool 300 is employed in a constant pressure or closed-center hydraulic power system. In order to operate the hydraulic utility pruning tool 300 such that the hydraulic utility pruner tool 300 is employed in a constant pressure or closed-center hydraulic system, the user first rotates the knob 362 of the adjustable valve member 350 in a second direction, preferably clockwise, such that the knob 362 of the adjustable valve member 350 turns into the valve chamber 348 until the valve 356 is fully seated within the valve seat 354. The valve 356 is fully seated within the valve seat 354 when the normally expanded spring 358 is fully contracted or solid, as best illustrated in FIG. 16.

In order to cut an article placed between the cutting blades, the user activates the trigger 344 by moving the trigger 344 toward the handle structure 328, as illustrated in FIG. 15. When the trigger 344 is in the position illustrated in FIG. 15, the inlet passageway 332 is not in fluid communication with the cross passageway 338. Rather, the inlet passageway 332 is placed into fluid communication with the central passageway 336 because of the positioning of the spindle valve 340 within the spindle valve chamber 341, and the cross passageway 338 is placed into fluid communication with the outlet passageway 334 through the passageway 380 of the spindle valve 340, because of the positioning of the spindle valve 340 within the spindle valve chamber 341. Thus, the hydraulic fluid from the reservoir flows into and through the inlet passageway 332, into the spindle valve chamber 341, around the reduced diameter section 349 of the spindle valve 340, into and through the central passageway 336, into and through the central tube 386, into and through the central chamber 384, into and through the radial passageways 382, and into the retract chamber 322.

As the amount of fluid in the retract chamber 322 increases, the pressure within the retract chamber 322 also increases, such that the driving piston 316 is retracted axially within the cavity 314. The driving piston 316 retracting within the cavity 314 axially retracts the extension rod 307 which, in turn, causes the cutting blades to close, such that the article to be cut by the cutting blades is cut. Retraction of the driving piston 316 within the cavity 314 causes the hydraulic fluid within the driving chamber 324 to flow out of the driving chamber 324, into and through the cross passageway 338, into the second port 383, through the passageway 380 of the spindle valve 340, out of the first port 381, into and through the outlet passageway 334, and back into the reservoir. The hydraulic fluid flowing through the cross passageway 338 to the outlet passageway 334 is prevented from flowing directly into the central passageway 336 to the inlet passageway 332 via the valve chamber 348 because the valve 356 is fully seated within the valve seat 354 as the spring 358 is fully contracted or solid.

Once a cut is made with the cutting blades, the user deactivates or releases the trigger 344 by moving the trigger 344 away from the handle structure 328, as illustrated in FIG. 14. When the trigger 344 is in the position illustrated in FIG. 14, the spindle valve 340 places the inlet passageway 332 into fluid communication with the cross passageway 338 as fluid is allowed to travel into the spindle valve chamber 341 and around the reduced diameter section 353 of the spindle valve 340. The spindle valve 340 also places the outlet passageway 334 into fluid communication with the central passageway 336 as fluid is allowed to travel into the spindle valve chamber 341 and around the reduced diameter section 349 of the spindle valve 340.

Thus, hydraulic fluid from the reservoir (not shown) of a hydraulic power system flows into the inlet passageway 332, into the spindle valve chamber 341, around the reduced diameter portion 353 of the spindle valve 340, into and through the cross passageway 338, and into the drive chamber 324. The hydraulic fluid flowing through the cross passageway 338 is prevented from flowing directly into the central passageway 336 via the valve chamber 348 because the valve 356 is fully seated within the valve seat 354 as the spring 358 is fully contracted.

As the amount of fluid in the drive chamber 324 increases, the pressure within the drive chamber 324 also increases, such that the driving piston 316 is caused to advance through the cavity 314. The advancement of the driving piston 316 through the cavity 314 advances the extension rod 307 such that the cutting blades are opened. Advancement of the driving piston 316 through the cavity 314 forces hydraulic fluid from the retract chamber 322 through the radial passageways 382, into and through the central chamber 384, into and through the central tube 386, into the spindle valve chamber 341, around the reduced diameter portion 349 of the spindle valve 340, into and through the outlet passageway 334, and into the reservoir.

Once the driving piston 316 comes to a fully advanced position, because the hydraulic fluid continues to fill in the drive chamber 324, pressure will continue to build within the cavity 314. Because the valve 356 is mechanically locked in the valve seat 354, such that hydraulic fluid is not allowed to flow past the valve 356, pressure will continue to build until it reaches a predetermined value established by a relief valve (not shown) in the hydraulic circuit. Relief valves within hydraulic circuits are well-known in the art and, therefore, are not explained herein in detail. In systems with a positive displacement pump, the relief valve diverts flow back to the reservoir. On systems with a variable stroking pump, pressure will continue to build until it reaches the predetermined value established by the relief valve, whose control system then reduces the flow of hydraulic fluid to adequately maintain system pressure.

In the constant pressure system, the force of the fluid within the cross passageway 338 is never sufficient to unseat the valve 356 from the valve seat 354 as the spring 358 is already fully contracted. Thus, the hydraulic fluid will never flow directly or continuously from the cross passageway 338, into the valve chamber 348, and back into the central passageway 336.

While preferred embodiments of the invention are shown and described, it is envisioned that those skilled in the art may devise various modifications without departing from the spirit and scope of the foregoing description and the appended claims.

The invention claimed is:

1. A hydraulic control mechanism which is selectively configurable for use, independently, with a constant volume hydraulic power system and a constant pressure hydraulic power system, said hydraulic control mechanism comprising:

a housing having a cavity defined by walls therein;

a piston retained in said cavity of said housing, said piston being capable of reciprocal movement within said cavity, said piston having a first side and a second side;

a retract chamber defined within said cavity between one of said walls of said cavity and said first side of said piston;

a drive chamber defined within said cavity between one of said walls of said cavity and said second side of said piston;

a controllable valve assembly coupled to said housing having an inlet passageway, an outlet passageway, a central passageway, and a cross passageway, said cross passageway being in fluid communication with said drive chamber, said central passageway being in fluid communication with said retract chamber; and an adjustment assembly coupled to said housing having a valve chamber and a valve member positioned within said valve chamber, said valve chamber being in fluid communication with said central passageway and said cross passageway, said valve chamber defining a valve seat proximate to one of said central and cross passageways, said valve member being displaceable within said valve chamber.

2. A hydraulic control mechanism as defined in claim 1, wherein when said hydraulic control mechanism is selectively configured for use with the constant volume hydraulic power system, said valve member is configured such that said valve member is seated within said valve seat to prevent communication between said central passageway and said cross passageway when a pressure within said hydraulic control mechanism is less than a predetermined pressure within said hydraulic control mechanism, said valve member further being configured such that said valve member is unseated from within said valve seat to allow communication between said central passageway and said cross passageway when said pressure within said hydraulic control mechanism is greater than or equal to said predetermined pressure within said hydraulic control mechanism.

3. A hydraulic control mechanism as defined in claim 2, wherein said valve chamber defines a valve seat proximate to said central passageway such that when said pressure within said central passageway of said hydraulic control mechanism is greater than or equal to said predetermined pressure within said hydraulic control mechanism, said valve member is unseated from said valve seat to place said central passageway into fluid communication with said cross passageway.

4. A hydraulic control mechanism as defined in claim 3, wherein said hydraulic control mechanism is provided for in a hydraulic crimping tool.

5. A hydraulic control mechanism as defined in claim 2, wherein said valve chamber defines a valve seat proximate to said cross passageway such that when said pressure within said cross passageway of said hydraulic control mechanism is greater than or equal to said predetermined pressure within said hydraulic control mechanism, said valve member is unseated from said valve seat to place said cross passageway into fluid communication with said central passageway.

6. A hydraulic control mechanism as defined in claim 5, wherein said hydraulic control mechanism is provided for in a hydraulic utility pruner tool.

7. A hydraulic control mechanism as defined in claim 1, wherein when said hydraulic control mechanism is selectively configured for use with the constant pressure hydraulic power system, said valve member is configured such that said valve member is seated within said valve seat to prevent fluid communication between said central passageway and said cross passageway regardless of a pressure within said hydraulic control mechanism.

8. A hydraulic control mechanism as defined in claim 7, wherein said valve chamber defines said valve seat proximate to said central passageway.

9. A hydraulic control mechanism as defined in claim 8, wherein said hydraulic control mechanism is provided for in a hydraulic crimping tool.

10. A hydraulic control mechanism as defined in claim 7, wherein said valve chamber defines said valve seat proximate to said cross passageway.

11. A hydraulic control mechanism as defined in claim 10, wherein said hydraulic control mechanism is provided for in a hydraulic utility pruner tool.

12. A hydraulic control mechanism as defined in claim 1, wherein said valve member includes a valve head, a normally expanded spring, an enlarged section and a knob, said normally expanded spring being connected to and positioned between said valve head and said enlarged section, said enlarged section being connected to and positioned between said normally expanded spring and said knob, said valve head capable of being seated within said valve seat, said knob capable of being moved to selectively configure said hydraulic control mechanism for use with the constant volume hydraulic power system or with the constant pressure hydraulic power system.

13. A hydraulic control mechanism as defined in claim 12, wherein when said knob is configured in a first position, said normally expanded spring is expanded such that said valve head is capable of being unseated from said valve seat to allow fluid communication between said central passageway and said cross passageway upon a pressure within said hydraulic control mechanism being greater than or equal to a predetermined pressure within said hydraulic control mechanism, such that said hydraulic control mechanism can be used with the constant volume hydraulic power system.

14. A hydraulic control mechanism as defined in claim 12, wherein when said knob is configured in a second position, said normally expanded spring is contracted such that said valve head is not capable of being unseated from said valve seat such that no fluid communication is allowed between said central passageway and said cross passageway, such that said hydraulic control mechanism can be used with the constant pressure hydraulic power system.

15. A hydraulic control mechanism as defined in claim 1, wherein said adjustment assembly further includes a retaining ring provided within said valve chamber for maintaining said valve member positioned within said valve chamber.

16. A hydraulic control mechanism as defined in claim 1, further including a spindle valve positioned within a spindle valve chamber of said housing, said spindle valve being displaceable within said spindle valve chamber such that said positioning of said spindle valve within said spindle valve chamber places said inlet passageway into fluid communication with one of said central passageway and said cross passageway, and such that said positioning of said spindle valve within said spindle valve chamber places said outlet passageway into fluid communication with the other of said central passageway and said cross passageway.

17. An adjustment assembly for selectively configuring a hydraulic control mechanism of a hydraulic tool for use, independently, with a constant volume hydraulic power system and a constant pressure hydraulic power system, the hydraulic control mechanism having a controllable valve assembly having a central passageway and a cross passageway, the central passageway communicating with a retract chamber of the hydraulic tool and the cross passageway communicating with a drive chamber of the hydraulic tool, said adjustment assembly comprising:

a valve chamber and a valve member positioned within said valve chamber, said valve chamber communicating with the central passageway and the cross passageway, said valve chamber defining a valve seat proximate to one of the central and cross passageways, said valve member being displaceable within said valve chamber.

18. An adjustment assembly as defined in claim 17, wherein when the hydraulic control mechanism is selectively configured for use with the constant volume hydraulic power system, said valve member is configured such that said valve member is seated within said valve seat to prevent fluid communication between the central passageway and the cross passageway when a pressure within the hydraulic control mechanism is less than a predetermined pressure within the hydraulic control mechanism, said valve member further being configured such that said valve member can be unseated from within said valve seat to allow fluid communication between the central passageway and the central passageway when said pressure within the hydraulic control mechanism is greater than or equal to said predetermined pressure within the hydraulic control mechanism.

19. An adjustment assembly as defined in claim 18, wherein said valve chamber defines a valve seat proximate to the central passageway such that when said pressure within the central passageway of the hydraulic control mechanism is greater than or equal to said predetermined pressure within the hydraulic control mechanism, said valve member is unseated from said valve seat to place the central passageway into fluid communication with the cross passageway.

20. An adjustment assembly as defined in claim 18, wherein said valve chamber defines a valve seat proximate to the cross passageway such that when said pressure within the cross passageway of the hydraulic control mechanism is greater than or equal to said predetermined pressure within the hydraulic control mechanism, said valve member is unseated from said valve seat to place the cross passageway into fluid communication with the central passageway.

21. An adjustment assembly as defined in claim 17, wherein when the hydraulic control mechanism is selectively configured for use with the constant pressure hydraulic power system, said valve member is configured such that said valve member is seated within said valve seat to prevent fluid communication between the central passageway and the cross passageway regardless of a pressure within the hydraulic control mechanism.

22. An adjustment assembly as defined in claim 17, wherein said valve chamber defines said valve seat proximate to the central passageway.

23. An adjustment assembly as defined in claim 17, wherein said valve chamber defines said valve seat proximate to the cross passageway.

24. An adjustment assembly as defined in claim 17, wherein said valve member includes a valve head, a normally expanded spring, an enlarged section and a knob, said normally expanded spring being connected to and positioned between said valve head and said enlarged section, said enlarged section being connected to and positioned between said normally expanded spring and said knob, said valve head capable of being seated within said valve seat, said knob capable of being moved to selectively configure said hydraulic control mechanism for use with the constant volume hydraulic power system or with the constant pressure hydraulic power system.

25. An adjustment assembly as defined in claim 24, wherein when said knob is configured in a first position, said normally expanded spring is expanded such that said valve head is capable of being unseated from said valve seat to allow communication between the central passageway and the cross passageway upon a pressure within the hydraulic control mechanism being greater than or equal to a predetermined pressure within the hydraulic control mechanism, such that the hydraulic control mechanism can be used with the constant volume hydraulic power system.

26. An adjustment assembly as defined in claim 24, wherein when said knob is configured in a second position, said normally expanded spring is contracted such that said valve head is not capable of being unseated from said valve seat such that no communication is allowed between the central passageway and the cross passageway, such that the hydraulic control mechanism can be used with the constant pressure hydraulic power system.

27. An adjustment assembly as defined in claim 17, further including a retaining ring provided within said valve chamber for maintaining said valve member positioned within said valve chamber.

28. A method of selectively configuring a hydraulic control mechanism for use, independently, with a constant volume hydraulic power system and a constant pressure hydraulic power system, said hydraulic control mechanism having a housing with a reciprocal piston retained therein which defines retract and drive chambers on either side thereof, and a controllable valve assembly coupled to the housing having a central passageway and a cross passageway, the central passageway being in fluid communication with the retract chamber and the cross passageway being in fluid communication with the drive chamber; said method comprising the steps of:

a) providing an adjustment assembly coupled to said housing having a valve chamber and a valve member positioned within said valve chamber, said valve chamber communicating with the central passageway and the cross passageway, said valve chamber defining a valve seat proximate to one of the central and cross passageways, said valve member being displaceable within said valve chamber; and b) positioning said valve member within said valve chamber such that said valve member is seated in said valve seat to prevent fluid communication between the central passageway and the cross passageway when a pressure within the hydraulic control mechanism is less then a predetermined pressure within the hydraulic control mechanism, and such that said valve member is unseated from said valve seat to allow fluid communication between the central passageway and the cross passageway when said pressure within the hydraulic control mechanism is greater than or equal to said predetermined pressure within the hydraulic control mechanism.

29. A method as defined in claim 28, further comprising the step of:

c) positioning said valve member within said valve chamber such that said valve member is always seated in said valve seat to prevent fluid communication between the central passageway and the cross passageway regardless of a pressure within the hydraulic control mechanism.

30. A method of selectively configuring a hydraulic control mechanism for use, independently, with a constant volume hydraulic power system and a constant pressure hydraulic power system, said hydraulic control mechanism having a housing with a reciprocal piston retained therein which defines retract and drive chambers on either side thereof, and a controllable valve assembly coupled to the housing having a central passageway and a cross passageway, the central passageway being in fluid communication with the retract chamber and the cross passageway being in fluid communication with the drive chamber; said method comprising the steps of:

a) providing an adjustment assembly coupled to said housing having a valve chamber and a valve member positioned within said valve chamber, said valve chamber communicating with the central passageway and the cross passageway, said valve chamber defining a valve seat proximate to one of the central and cross passageways, said valve member being displaceable within said valve chamber; and b) positioning said valve member within said valve chamber such that said valve member is always seated in said valve seat to prevent fluid communication between the central passageway and the cross passageway regardless of a pressure within the hydraulic control mechanism.

* * * * *